US009239530B2

(12) United States Patent
Asahina et al.

(10) Patent No.: US 9,239,530 B2
(45) Date of Patent: Jan. 19, 2016

(54) TONER FOR FORMING ELECTROSTATIC IMAGE, DEVELOPER, PROCESS CARTRIDGE, AND IMAGE FORMING APPARATUS

(71) Applicants: Daisuke Asahina, Shizuoka (JP); Hiroshi Yamashita, Shizuoka (JP); Masana Shiba, Shizuoka (JP); Tsuyoshi Sugimoto, Shizuoka (JP); Yukari Fukuda, Kanagawa (JP); Rintaro Takahashi, Kanagawa (JP)

(72) Inventors: Daisuke Asahina, Shizuoka (JP); Hiroshi Yamashita, Shizuoka (JP); Masana Shiba, Shizuoka (JP); Tsuyoshi Sugimoto, Shizuoka (JP); Yukari Fukuda, Kanagawa (JP); Rintaro Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/025,128

(22) Filed: Sep. 12, 2013

(65) Prior Publication Data

US 2014/0080046 A1 Mar. 20, 2014

(30) Foreign Application Priority Data

Sep. 18, 2012 (JP) ..... 2012-204162

(51) Int. Cl.
*G03G 9/087* (2006.01)
*G03G 9/08* (2006.01)

(52) U.S. Cl.
CPC ..... *G03G 9/08755* (2013.01); *G03G 9/0821* (2013.01); *G03G 9/08793* (2013.01); *G03G 9/08795* (2013.01); *G03G 9/08797* (2013.01)

(58) Field of Classification Search
CPC .. G03G 9/08; G03G 9/08755; G03G 9/08797
USPC ..... 430/109.4, 109.1, 111.4; 399/111
See application file for complete search history.

(56) References Cited

U.S. PATENT DOCUMENTS

| | | | | |
|---|---|---|---|---|
| 6,503,676 | B2 | 1/2003 | Yamashita et al. | |
| 7,214,461 | B2 | 5/2007 | Yamashita et al. | |
| 7,435,521 | B2 | 10/2008 | Yagi et al. | |
| 7,455,942 | B2 | 11/2008 | Nagatomo et al. | |
| 2003/0022084 | A1 | 1/2003 | Sugiyama et al. | |
| 2003/0138717 | A1 | 7/2003 | Yagi et al. | |
| 2003/0219669 | A1 | 11/2003 | Yamashita et al. | |
| 2004/0076900 | A1 | 4/2004 | Sugiyama et al. | |
| 2004/0115551 | A1 | 6/2004 | Sugiyama et al. | |
| 2004/0121256 | A1 | 6/2004 | Suzuki et al. | |
| 2004/0131961 | A1 | 7/2004 | Watanabe et al. | |
| 2004/0185365 | A1 | 9/2004 | Saito et al. | |
| 2005/0003288 | A1 | 1/2005 | Sugiyama et al. | |
| 2005/0079433 | A1 | 4/2005 | Watanabe et al. | |
| 2005/0196691 | A1 | 9/2005 | Ohtani et al. | |
| 2005/0196692 | A1 | 9/2005 | Yamashita et al. | |
| 2006/0068312 | A1 | 3/2006 | Yamashita et al. | |
| 2006/0172214 | A1 | 8/2006 | Saito et al. | |
| 2006/0240349 | A1 | 10/2006 | Watanabe et al. | |
| 2007/0031752 | A1 | 2/2007 | Watanabe et al. | |
| 2008/0032226 | A1 | 2/2008 | Sugiyama et al. | |
| 2008/0070151 | A1 | 3/2008 | Sugimoto et al. | |
| 2008/0227002 | A1 | 9/2008 | Moriya et al. | |
| 2008/0280218 | A1 | 11/2008 | Sabu et al. | |
| 2008/0280219 | A1 | 11/2008 | Nakayama et al. | |
| 2008/0318144 | A1 | 12/2008 | Watanabe et al. | |
| 2008/0318148 | A1 | 12/2008 | Sugimoto et al. | |
| 2009/0053644 | A1 | 2/2009 | Sacripante | |
| 2009/0074467 | A1 | 3/2009 | Seshita et al. | |
| 2009/0092917 | A1 | 4/2009 | Sugimoto et al. | |
| 2009/0104555 | A1 | 4/2009 | Wakamatsu et al. | |
| 2009/0214973 | A1 | 8/2009 | Sugimoto et al. | |
| 2009/0325099 | A1 | 12/2009 | Watanabe et al. | |
| 2010/0035170 | A1 | 2/2010 | Sugimoto et al. | |
| 2011/0033203 | A1 | 2/2011 | Watanabe et al. | |
| 2011/0065036 | A1* | 3/2011 | Inoue et al. | 430/108.4 |
| 2011/0076607 | A1 | 3/2011 | Sugimoto et al. | |
| 2011/0262853 | A1 | 10/2011 | Watanabe et al. | |
| 2011/0294058 | A1 | 12/2011 | Shiba et al. | |
| 2012/0064447 | A1 | 3/2012 | Hozumi et al. | |
| 2012/0065357 | A1 | 3/2012 | Yamauchi et al. | |
| 2012/0082926 | A1 | 4/2012 | Suzuki et al. | |
| 2012/0189951 | A1* | 7/2012 | Sugimoto et al. | 430/108.1 |
| 2012/0219896 | A1 | 8/2012 | Asahina et al. | |
| 2012/0231387 | A1* | 9/2012 | Sugiura | 430/108.4 |
| 2012/0295193 | A1 | 11/2012 | Hanatani et al. | |
| 2013/0011779 | A1 | 1/2013 | Yamashita et al. | |
| 2013/0059247 | A1 | 3/2013 | Sugimoto et al. | |
| 2013/0130171 | A1 | 5/2013 | Watanabe et al. | |
| 2013/0157184 | A1* | 6/2013 | Sugimoto et al. | 430/105 |
| 2013/0157185 | A1 | 6/2013 | Sakashita et al. | |

(Continued)

FOREIGN PATENT DOCUMENTS

| | | | |
|---|---|---|---|
| EP | 2151719 | A1 * | 2/2010 |
| JP | 2005-338814 | | 12/2005 |

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

*Primary Examiner* — Christopher Rodee
(74) *Attorney, Agent, or Firm* — Oblon, McClelland, Maier & Neustadt, L.L.P.

(57) ABSTRACT

To provide a toner, which contains a colorant, a binder resin, and a releasing agent, wherein the toner satisfies the following (a) to (c): (a) the toner contains at least a polyester resin as the binder resin; (b) the toner has Tg1st of 25° C. to 50° C.; and (c) the toner has a TMA compressive deformation rate (TMA %) of 10% or lower at 50° C. under a condition having relative humidity of 70%, wherein the Tg1st is glass transition temperature of the toner for first heating, as the toner is measured by a DSC system (a differential scanning calorimeter).

9 Claims, 4 Drawing Sheets

(56) References Cited

U.S. PATENT DOCUMENTS

| | | | | |
|---|---|---|---|---|
| 2013/0157193 | A1 | 6/2013 | Moritani et al. | |
| 2013/0196263 | A1 * | 8/2013 | Asahina et al. | 430/109.4 |
| 2013/0244169 | A1 | 9/2013 | Miyaake et al. | |

FOREIGN PATENT DOCUMENTS

| | | |
|---|---|---|
| JP | 2009-053695 | 3/2009 |
| JP | 2011-095286 | 5/2011 |
| JP | 2011-123483 | 6/2011 |
| JP | 2011-150229 | 8/2011 |
| JP | 2012-128405 | 7/2012 |
| JP | 2012-168505 | 9/2012 |
| JP | 2012-194515 | 10/2012 |
| JP | 2013-54178 | 3/2013 |
| JP | 2013-156475 | 8/2013 |

* cited by examiner

TONER FOR FORMING ELECTROSTATIC IMAGE, DEVELOPER, PROCESS CARTRIDGE, AND IMAGE FORMING APPARATUS

BACKGROUND OF THE INVENTION

1. Field of the Invention

The present invention relates to a toner for forming an electrostatic image, which is used in an electrophotographic image forming apparatus, such as a photocopier, a printer, and FAX, and to a developer using the toner, a process cartridge, and an image forming apparatus in which the process cartridge is mounted.

2. Description of the Related Art

A technology for fixing a toner with low energy is desired because of the recent prosperity of environmentally friendly products. There are various ways for achieving such fixing, but among them, there is a strong demand for a toner for forming an electrostatic image, which can be fixed at low temperature.

As a method for lowering fixing temperature of a toner, typically performed is to lower glass transition temperature (Tg) of a toner binder. As Tg is merely made low, however, aggregation (blocking) of powder tends to occur. If the toner powder is aggregated inside an image forming apparatus, operation of a developing device is affected, and there is a case where the developing device cannot be operated. Even if the developing device can be still operated, a toner cannot be supplied, as the toner is aggregated inside a toner container, which leads to low toner density, and formation of defective images.

As a toner is designed to have low Tg, moreover, the toner tends to deposit on a carrier, a photoconductor, and various blades, and therefore defective images may be formed. Accordingly, it is necessary to prevent occurrences of blocking or filming, and to improve anti-blocking property of a toner. Moreover, shelf stability of a toner present at a surface of a fixed image is degraded, as Tg is low. If the fixed image is easily melted and dislocated, the toner may be deposited to another recording medium stacked on the recording medium bearing the fixed image, and therefore it may not be able to store the fixed image for a long period.

Tg is an important factor in the design of a toner binder. In according to a method merely reducing Tg, a toner, which can be fixed by a fixing device temperature of which is set lower than temperature used in conventional art, has not been obtained.

Meanwhile, as a method for achieving anti-blocking property, anti-filming property, and low temperature fixing ability of a toner, use of a crystalline resin as a toner binder has been known for a long time. However, such toner has a problem that hot offset is caused due to lack of elasticity when the toner is melted.

Moreover, as a method for achieving anti-blocking property, anti-filming property, and low temperature fixing ability of a toner, proposed is a core-shell type toner having a shell, formed by a melt suspension method, or emulsification aggregation method (see, for example, Japanese Patent Application Laid-Open (JP-A) Nos. 2009-053695, and 2011-150229). However, these toners are still insufficient to achieve excellent anti-blocking properties and anti-filming properties, while maintaining low temperature fixing abilities.

Furthermore, to solve the aforementioned problem, proposed is a method focusing on a crystalline resin (see JP-A No. 2011-123483). However, such crystalline resin is easily influenced by external conditions (heat history during production, storage, and fixing, and partial phase mixing), and a crystalline structure thereof is not stable, which may adversely affect various properties of a toner, anti-blocking property, and image stability.

In accordance with these conventional techniques, moreover, the crystalline polyester resin sharply melts compared to a non-crystalline polyester resin, and therefore these toners can achieve low temperature fixing ability. It is possible to achieve both low temperature fixing ability and heat resistant storage stability of a toner according to these conventional techniques, however, there are problems, particularly in the case where a toner is used in a high-speed device, that the toner forms aggregates as stress applied to the toner in the developing device is large, and a white missing area (transfer missing) is formed on an output toner image due to a doctor blockage. In case of a toner containing a crystalline polyester resin, moreover, there is a problem that the toner forms aggregates in high temperature high humidity environment.

Accordingly, it is current situation that there is needs for a toner, which has low temperature fixing ability, anti-blocking property, and anti-filming property, and capable of preventing transfer missing.

SUMMARY OF THE INVENTION

The present invention aims to provide a toner for forming a latent electrostatic image, which realizes low temperature fixing ability, anti-blocking property, anti-filming property, and prevention of transfer white missing.

As for the means for solving the aforementioned problems, the toner of the present contains a colorant, a binder resin, and a releasing agent, wherein the toner satisfies the following (a) to (c): (a) the toner contains at least a polyester resin as the binder resin; (b) the toner has Tg1st of 25° C. to 50° C.; and (c) the toner has a TMA compressive deformation rate (TMA %) of 10% or lower at 50° C. under a condition having relative humidity of 70%, wherein the Tg1st is glass transition temperature of the toner for first heating, as the toner is measured by a DSC system (a differential scanning calorimeter).

The present invention can solve the aforementioned various problems in the art, and can provide a toner for forming a latent electrostatic image, which realizes low temperature fixing ability, anti-blocking property, anti-filming property, and prevention of transfer white missing.

Specifically, the toner has the anti-blocking property just before heat is applied to the toner for fixing, and enables low temperature fixing as the toner exhibits sharp softening when heat is applied, and therefore the toner can realize low temperature fixing ability, anti-blocking property, anti-filming property, and prevention of transfer white missing, which are paradoxical characteristics.

DETAILED DESCRIPTION OF THE INVENTION (Toner)

Figure 1:
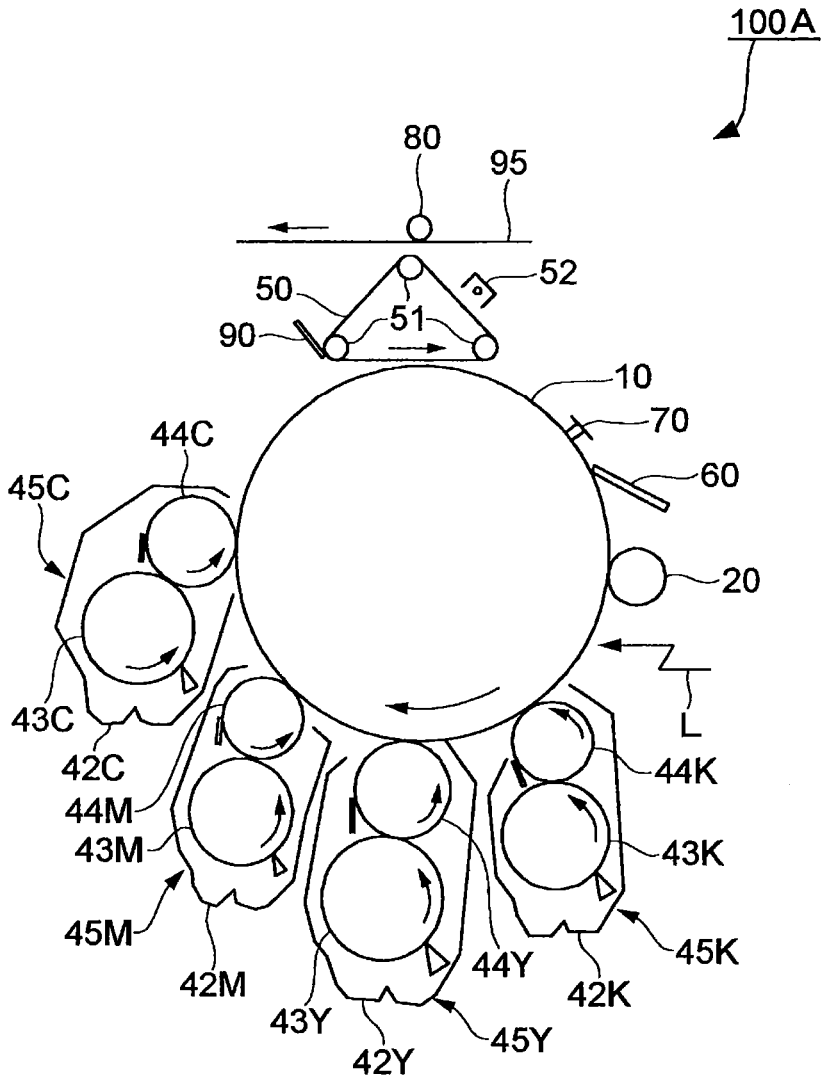
FIG. 1 is a schematic diagram illustrating one example of the image forming apparatus of the present invention.

The toner of the present invention contains at least a colorant, a binder resin, and a releasing agent, and may further contain other components, if necessary.

Moreover, the toner contains a polyester resin as the binder resin. The toner preferably contains at least one non-crystalline resin, as the polyester resin.

<Non-Crystalline Polyester Resin>

The non-crystalline polyester resin contains a diol component as a constitutional component. The diol component contains C3-C10 aliphatic diol in an amount of 50 mol % or greater. The non-crystalline polyester resin, moreover, contains trivalent or higher acid, or trihydric or higher alcohol, as a crosslink component.

The non-crystalline polyester resin may be used alone, or in combination. The non-crystalline polyester resin is preferably a non-crystalline polyester resin obtained through a reaction between an active hydrogen group-containing compound and a polymer reactable with the active hydrogen group-containing compound, as such resin has excellent adhesion to a recording medium, such as paper. More preferably, the non-crystalline polyester resin contains a urethane bond and/or urea bond. In such non-crystalline polyester resin, a urethane bond and/or urea bond acts as an apparent crosslink points, and therefore rubber characteristics of the non-crystalline polyester resin is enhanced, to thereby improve heat resistance storage stability and hot offset resistance of a resulting toner.

—Diol—

The diol is appropriately selected depending on the intended purpose without any limitation, provided that the diol contains C3-C10 aliphatic diol in an amount of 50 mol % or greater. Examples thereof include: aliphatic diol, such as ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol; diol containing an oxyalkylene group, such as diethylene glycol, triethylene glycol, dipropylene glycol, polyethylene glycol, polypropylene glycol, and polytetramethylene glycol; alicyclic diol, such as 1,4-cyclohexane dimethanol, and hydrogenated bisphenol A; alkylene oxide (e.g., ethylene oxide, propylene oxide, and butylene oxide) adduct of alicyclic diol; bisphenol, such as bisphenol A, bisphenol F, and bisphenol S; and alkylene oxide (e.g., ethylene oxide, propylene oxide, and butylene oxide) adduct of bisphenol. Among them, C3-C7 aliphatic diol is preferable.

These diols may be used alone, or in combination.

Moreover, it is preferred that the number of carbon atoms in a principle chain of the diol component be an odd number, and the diol component have an alkyl group at a side chain thereof, as a resulting non-crystalline resin can exhibit rubber elasticity with maintaining high thermal deformability in a fixing temperature range, to thereby further improve low temperature fixing ability and anti-blocking property of a resulting toner.

—Dicarboxylic Acid—

The dicarboxylic acid is appropriately selected depending on the intended purpose without any limitation, and examples thereof include aliphatic dicarboxylic acid, and aromatic dicarboxylic acid. Moreover, anhydride thereof, lower (C1-C3) alkyl ester thereof, and halogenated product thereof may be used.

The aliphatic dicarboxylic acid is appropriately selected depending on the intended purpose without any limitation, and examples thereof include succinic acid, adipic acid, sebacic acid, dodecanedioic acid, maleic acid, and fumaric acid.

The aromatic dicarboxylic acid is appropriately selected depending on the intended purpose without any limitation, and examples thereof include phthalic acid, isophthalic acid, terephthalic acid, and naphthalene dicarboxylic acid. Among them, C4-C12 aliphatic dicarboxylic acid is preferable.

These dicarboxylic acids may be used alone, or in combination.

—Trivalent or Higher Acid or Trihydric or Higher Alcohol—

The trivalent or higher acid or trihydric or higher alcohol is appropriately selected depending on the intended purpose without any limitation. Examples thereof include trimellitic acid, pyromellitic acid, glycerin, trimethylol ethane, trimethylol propane, pentaerythritol, sorbitol, sorbitan, and dipentaerythritol. These trivalent or higher acids or trihydric or higher alcohols may be used alone, or in combination.

When the trivalent or higher acid or trihydric or higher alcohol is contained, rubber elasticity is exhibited, and anti-blocking property is improved even further. Use of trivalent acid or trihydric alcohol is preferable, as rubber elasticity is exhibited while maintaining high thermal deformability of the resin in a fixing temperature range, and low temperature fixing ability and anti-blocking property of a resulting toner are improved.

—Polyester Resin Containing Urethane Bond and/or Urea Bond—

The polyester resin containing a urethane bond and/or urea bond is appropriately selected depending on the intended purpose without any limitation, and examples thereof include a reaction product between a polyester resin containing an active hydrogen group and polyisocyanate.

—Polyisocyanate—

The polyisocyanate is appropriately selected depending on the intended purpose without any limitation, and examples thereof include diisocyanate, and trivalent or higher isocyanate.

Examples of the diisocyanate include aliphatic diisocyanate, alicyclic diisocyanate, aromatic diisocyanate, aromatic aliphatic diisocyanate, isocyanurate, a phenol derivative thereof, a blocked product thereof with oxime or caprolactam.

The aliphatic diisocyanate is appropriately selected depending on the intended purpose without any limitation. Examples thereof include tetramethylene diisocyanate, hexamethylene diisocyanate, 2,6-diisocyanatomethylcaproate, octamethylene diisocyanate, decamethine diisocyanate, dodecamethylene diisocyanate, tetradecamethylene diisocyanate, trimethylhexane diisocyanate, tetramethylhexane diisocyanate.

The alicyclic diisocyanate is appropriately elected depending on the intended purpose without any limitation, and examples thereof include isophorone diisocyanate, and cyclohexylmethane diisocyanate.

The aromatic diisocyanate is appropriately selected depending on the intended purpose without any limitation, and examples thereof include tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenyl ether-4,4'-diisocyanate.

The aromatic aliphatic diisocyanate is appropriately selected depending on the intended purpose without any limitation, and examples thereof include $\alpha,\alpha,\alpha',\alpha'$-tetramethylxylene diisocyanate.

The isocyanurate is appropriately selected depending on the intended purpose without any limitation, and examples thereof include tris(isocyanatoalkyl)isocyanurate, and tris (isocyanatocycloalkyl)isocyanurate.

These polyisocyanates may be used alone, or in combination, Moreover, the polyisocyanate is preferably used as a reaction precursor (referred to as "prepolymer" hereinafter) to be reacted with a curing agent described below.

—Curing Agent—

The curing agent is appropriately selected depending on the intended purpose without any limitation, provided that it is reactable with the prepolymer. Examples thereof include an active hydrogen group-containing compound.

—Active Hydrogen Group-Containing Compound—

An active hydrogen group contained in the active hydrogen group-containing compound is appropriately selected depending on the intended purpose without any limitation, and examples thereof include a hydroxyl group (alcoholic hydroxyl group, and phenolic hydroxyl group), an amino group, a carboxyl group, and a mercapto group. These may be used alone, or in combination.

The active hydrogen group-containing compound is appropriately selected depending on the intended purpose without any limitation, but it is preferably amine as a urea bond can be formed.

The amine is appropriately selected depending on the intended purpose without any limitation, and examples thereof include diamine, trivalent or higher amine, aminoalcohol, aminomercaptane, amino acid, and a blocked product thereof, in which an amino group of any of the aforementioned amines is blocked.

The diamine is appropriately selected depending on the intended purpose without any limitation, and examples thereof include aromatic diamine, alicyclic diamine, and aliphatic diamine.

The aromatic diamine is appropriately selected depending on the intended purpose without any limitation, and examples thereof include phenylene diamine, diethyltoluene diamine, and 4,4'-diaminodiphenyl methane. The alicyclic diamine is appropriately selected depending on the intended purpose without any limitation, and examples thereof include 4,4'-diamino-3,3'-dimethyldicyclohexyl methane, diaminocyclohexane, and isophorone diamine. The aliphatic diamine is appropriately selected depending on the intended purpose without any limitation, and examples thereof include ethylene diamine, tetramethylene diamine, and hexamethylene diamine.

The trivalent or higher amine is appropriately selected depending on the intended purpose without any limitation, and examples thereof include diethylene triamine, and triethylene tetramine.

The amino alcohol is appropriately selected depending on the intended purpose without any limitation, and examples thereof include aminoethylmercaptan, and aminopropylmercaptan.

The amino acid is appropriately selected depending on the intended purpose without any limitation, and examples thereof include aminopropionic acid, and aminocaproic acid.

The blocked product in which the amino group is blocked is appropriately selected depending on the intended purpose without any limitation, and examples thereof include a ketimine compound, and oxazoline compound, which are obtained by blocking the amino group with ketone (e.g., acetone, methyl ethyl ketone, and methyl isobutyl ketone).

A molecular structure of the non-crystalline polyester resin can be confirmed by a liquid or solid NMR, X-ray diffraction, GC/MS, LC/MS, or IR spectroscopy. For example, a simple method thereof include a method for detecting a component that does not have absorption peals derived from SCH (out plane bending) of olefin at 965±10 $cm^{-1}$ and 990±10 $cm^{-1}$ in the infrared absorption (IR) spectrum as a non-crystalline polyester resin.

An amount of the non-crystalline polyester resin used as the prepolymer is appropriately selected depending on the intended purpose without any limitation, and the amount thereof is preferably 5 parts by mass to 25 parts by mass, more preferably 10 parts by mass to 20 parts by mass, relative to 100 parts by mass of the toner. When the amount thereof is less than 5 parts by mass, low temperature fixing ability and hot offset resistance may be impaired. When the amount thereof is greater than 25 parts by mass, heat resistant storage stability may be impaired, or glossiness of an image obtained after fixing may be impaired. The amount thereof within the aforementioned preferable range is preferable, as a resulting toner excels all in low temperature fixing ability, hot offset resistance, and anti-blocking property.

The crystalline polyester resin preferably contains two or more polyester resins, and preferably contains an unmodified polyester resin in addition to the urethane or urea-modified polyester resin. The unmodified polyester resin is a polyester resin obtained from polyhydric alcohol, and polycarboxylic acid (e.g., polycarboxylic acid, polycarboxylic anhydride, and polycarboxylic acid ester) or a derivative thereof, and is a polyester resin that is not modified with an isocyanate compound or the like.

Examples of the polyhydric alcohol include diol.

Examples of the diol include: a bisphenol A alkylene (C2-C3) oxide (the average added mole number: 1 to 10) adduct, such as polyoxypropylene(2.2)-2,2-bis(4-hydroxyphenyl) propane, polyoxyethylene(2.2)-2,2-bis(4-hydroxyphenyl) propane; ethylene glycol; propylene glycol; hydrogenated bisphenol A; and a hydrogenated bisphenol A alkylene (C2-C3) oxide (the average added mole number: 1 to 10) adduct.

These may be used alone, or in combination.

Examples of the polycarboxylic acid include dicarboxylic acid.

Examples of the dicarboxylic acid include: adipic acid; phthalic acid; isophthalic acid; terephthalic acid; maleic acid; and succinic acid substituted with C1-C20 alkyl group or C2-C20 alkenyl group, such as dodecenyl succinic acid, and octyl succinic acid. These may be used alone, or in combination.

Moreover, the unmodified polyester resin may contain trivalent or higher carboxylic acid, trihydric or higher alcohol, or both thereof at a terminal of a molecular chain of the resin for the purpose of adjusting an acid value and/or hydroxyl value thereof.

Examples of the trivalent or higher carboxylic acid include trimellitic acid, pyromellitic acid, and acid anhydride thereof.

Examples of the trihydric or higher alcohol include pentaerythritol, and trimethylol propane.

A molecular weight of the unmodified polyester resin is appropriately selected depending on the intended purpose without any limitation. When the molecular weight thereof is excessively small, however, heat resistant storage stability of a resulting toner, or durability thereof against the stress caused by stirring inside a developing device may be impaired. When the molecular weight thereof is excessively large, viscoelasticity of a resulting toner during being melted becomes high, and therefore low temperature fixing ability of the toner may be impaired. Accordingly, the weight average molecular weight (Mw) of the unmodified polyester resin as measured by gel permeation chromatography (GPC) is preferably 3,000 to 10,000, more preferably 4,000 to 7,000. Moreover, the number average molecular weight (Mn)

thereof is preferably 1,000 to 4,000, more preferably 1,500 to 3,000. The ratio Mw/Mn is preferably 1.0 to 4.0, more preferably 1.0 to 3.5.

An acid value of the unmodified polyester resin is appropriately selected depending on the intended purpose without any limitation, but the acid value thereof is preferably 1 mgKOH/g to 50 mgKOH/g, more preferably 5 mgKOH/g to 30 mgKOH/g. When the acid value thereof is 1 mgKOH/g or greater, a resulting toner tends to be negatively charged, improves affinity to paper as fixed to paper, and can improve its low temperature fixing ability. When the acid value thereof is greater than 50 mgKOH/g, charge stability of a resulting toner, especially the charge stability thereof against the fluctuations of the environmental conditions, may be impaired.

A hydroxyl value of the unmodified polyester resin is appropriately selected depending on the intended purpose without any limitation, and the hydroxyl value thereof is preferably 5 mgKOH/g or greater.

The glass transition temperature (Tg) of the unmodified polyester resin is preferably 40° C. to 70° C. When the glass transition temperature is lower than 40° C., blocking resistance of a resulting toner and resistance thereof against stress, such as stirring inside a developing device, may be impaired, and anti-filming property thereof may be impaired. When the glass transition temperature thereof is higher than 70° C., on the other hand, deformation of a resulting toner by heat and pressure applied during fixing is insufficient, which may lead to insufficient low temperature fixing ability of the toner.

A molecular structure of the unmodified polyester resin can be confirmed by a liquid or solid NMR, X-ray diffraction, GC/MS, LC/MS, or IR spectroscopy. For example, a simple method thereof include a method for detecting, as a non-crystalline resin, a component that does not have absorption peaks derived from δCH (out plane bending) of olefin at 965±10 $cm^{-1}$ and 990±10 $cm^{-1}$ in the infrared absorption (IR) spectrum.

An amount of the unmodified polyester resin is appropriately selected depending on the intended purpose without any limitation, but the amount thereof is preferably 50 parts by mass to 90 parts by mass, more preferably 60 parts by mass to 80 parts by mass relative to 100 parts by mass of a toner. When the amount thereof is smaller than 50 parts by mass, the dispersibility of the pigment or releasing agent in the toner is impaired, which may cause fogging or disturbance in a resulting image. When the amount thereof is greater than 90 parts by mass, low temperature fixing ability of a resulting toner may be impaired, as the amounts of the crystalline polyester resin and modified polyester resin are small. Use of the unmodified polyester resin in an amount of the aforementioned more preferable range is advantageous, because a resulting toner achieve both excellent image quality and low temperature fixing ability.

Moreover, the toner of the present invention preferably contains a non-crystalline polyester A and a crystalline polyester B as the binder resin. As for the non-crystalline polyester A, the aforementioned non-crystalline polyester resin is used.

<Crystalline Polyester Resin B>

The crystalline polyester resin B preferably has a melting point of 50° C. to 100° C., more preferably 60° C. to 80° C. The viscosity of the crystalline polyester resin B sharply drops at a melting point thereof. When a resulting toner is stored at temperature equal to or higher than the melting point of the crystalline polyester resin B, the toner is aggregated and blocking occurs. Accordingly, the melting point of the crystalline polyester resin B is preferably temperature higher than the temperature at which a resulting toner is stored or used. Specifically, the melting point of the crystalline polyester resin B is preferably 50° C. or higher. Moreover, the melting point thereof is preferably 100° C. or lower for achieving low temperature fixing ability of a resulting toner.

The melting point of the crystalline polyester resin B can be determined as fusion peak temperature as measured by power compensation differential scanning calorimetry specified in JISK-7121. Note that, there is a case where a crystalline resin has a plurality of fusion peaks. In this case, the maximum peak thereof is determined as a melting point.

The crystalline polyester resin B is preferably obtained by allowing a mixture of divalent or trivalent or higher unsaturated carboxylic acid containing a unsaturated double bond and divalent or trivalent or higher saturated carboxylic acid to react with dihydric or trihydric or higher alcohol through a condensation reaction. Such crosslinked crystalline polyester resin is not particularly limited, and may be selected from commercial products, or may be appropriately synthesized for use.

Examples of the divalent unsaturated carboxylic acid include maleic acid, maleic anhydride, fumaric citraconic acid, and itaconic acid.

Examples of the divalent saturated carboxylic acid include: dibasic acid, such as oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid, and mesaconic acid; and anhydride thereof and lower alkyl ester thereof.

Examples of the trivalent or higher carboxylic acid include 1,2,4-benzene tricarboxylic acid, 1,2,5-benzene tricarboxylic acid, 1,2,4-naphthalene tricarboxylic acid, and anhydride thereof, and lower alkyl ester thereof.

These carboxylic acids may be used alone or in combination.

Examples of the dihydric alcohol include bisphenol A, hydrogenated bisphenol A, ethylene oxide and/or propylene oxide adduct of bisphenol A, 1,4-cyclohexanediol, 1,4-cyclohexane dimethanol, ethylene glycol, diethylene glycol, propylene glycol, dipropylene glycol, 1,3-butanediol, 1,4-butanediol, 1,5-pentanediol, 1,6-hexanediol, neopentyl glycol, and xylylene glycol.

Examples of the trihydric or higher alcohol include glycerin, trimethylol ethane, trimethylol propane, and pentaerythritol.

These alcohols may be used alone, or in combination.

For the purpose of controlling an acid value or hydroxyl value of a toner, a monovalent acid, such as acetic acid, and benzoic acid, or a monohydric alcohol, such as cyclohexanol, and benzyl alcohol, is also optionally used.

In the present invention, one or a plurality of the aforementioned unsaturated double bond-containing polyester resin is used as the crystalline polyester resin B, but another non-crosslinked resin may be added thereto. The non-crosslinked resin may be appropriately selected from those known in the art.

Note that, a crystal nucleus agent may be added, or a post-cure treatment, such as annealing, may be performed to increase a crystalline degree of the crystalline polyester resin B, as long as an obtainable effect of the present invention is not impaired.

The crystalline polyester resin B preferably contains C4-C12 linear unsaturated aliphatic dicarboxylic acid in an amount of 80 mol % or greater relative to the entire acid components, and C2-C12 linear saturated aliphatic diol in an amount of 80 mol % or greater relative to the entire alcohol components. The toner containing such crystalline polyester resin B enhances its crystallinity, to thereby improve sharp melt characteristics, and exhibit excellent low temperature fixing ability.

—Fixing Aiding Component—

The toner of the present invention preferably contains a fixing aiding component. The fixing aiding component present as a crystal domain in the toner in a non-compatible state before the toner is fixed. The fixing aiding components melts with heat applied during the fixing, and becomes compatible with the binder resin to be plasticized. Therefore, anti-blocking property and low temperature fixing ability of a resulting toner can be improved. The fixing aiding component is appropriately selected from one having a function of plasticizing a resin, but it is preferably one that can increase a difference Tg1st and Tg2nd of the toner, which will be described below. Examples of the fixing aiding component include fatty acid ester, aliphatic amide, fatty acid, and aliphatic alcohol. However, the aforementioned crystalline polyester resin in the binder resin has an excellent function of a fixing aiding component, as well as a function of a binder resin.

Tg1st and Tg2nd of the toner of the present invention will be explained hereinafter.

The toner is a sample, and is subjected to a measurement by means of the below-mentioned DSC system. In the present invention, the glass transition temperature determined from the first heating is determined as Tg1st, and the glass transition temperature determined from the second heating is determined as Tg2nd.

<Measuring Method of Melting Point and Glass Transition Temperature (Tg)>

The melting point and glass transition temperature (Tg) of the present invention can be measured by means of a DSC system (a differential scanning calorimeter) (Q-200, manufactured by TA Instruments Japan Inc.).

Specifically, a melting point and glass transition temperature of a sample, such as a toner, can be measured in the following manner.

—Pretreatment—

The toner of the present invention has Tg1st of 25° C. to 50° C., but Tg1st thereof is easily varied due to thermal history of the toner, or a morphological change of the binder resin, which is for example a change of a compatible state with a third component, such as a fixing aiding component. In order to erase the thermal history of the toner, therefore, the toner is stored for 24 hours at 50° C. Within 24 hours from the completion of the storage, DSC is performed to calculate Tg1st. By performing the aforementioned pretreatment, the thermal history of the toner is erased, and an accurate Tg1st thereof can be calculated.

—Measurement—

For the measurement, first, a sample (about 5.0 mg) is placed in an aluminum sample container, and the sample contained is placed in a holder unit, which is then set in an electric furnace. Subsequently, the sample is heated from −80° C. to 150° C. at the heating rate of 10° C./min in a nitrogen atmosphere (first heating). Thereafter, the sample is cooled from 150° C. to −80° C. at the cooling rate of 10° C./min, followed by heating the sample to 150° C. at the heating rate of 10° C./min (second heating). For each of the first heating and the second heating, a DSC curve is measured by means of a differential scanning calorimeter (Q-200, manufactured by TA Instruments Japan Inc.).

By using an analysis program stored in the Q-200 system, a DSC curve of the first heating is selected from the obtained DSC curve, to thereby determine glass transition temperature of the sample from the first heating. Similarly, a DSC curve of the second heating is selected, and glass transition temperature of the sample from the second heating can be determined.

Moreover, a DSC curve of the first heating is selected from the obtained DSC curve using an analysis program stored in the Q-200 system, and absorption peak top temperature of the sample from the first heating can be determined as a melting point of the sample. Similarly, a DSC curve of the second heating is selected, absorption peak top temperature of the sample from the second heating can be determined as a melting point of the sample.

The thermal characteristics of the toner of the present invention are explained.

As for the thermal characteristics of the toner, the obtained toner base particles preferably have glass transition temperature Tg of 25° C. to 45° C. When Tg of the toner is lower than 25° C., the toner may cause blocking in a developing device, or filming to a photoconductor. When Tg thereof is higher than 45° C., the toner may have poor low temperature fixing ability.

In addition to the aforementioned Tg, the toner has TMA compressive deformation rate (TMA %) of 10% or lower at 50° C. under a condition having relative humidity of 70%. TMA % thereof is preferably 7% or lower. The value of TMA % is greater than 10% means that the toner is easily deformed in a case it is transported in summer, or transported by a ship, and even if such toner has excellent static stability as measured by a penetration depth test, or excellent shelf stability under dry conditions, it has poor shelf stability under dynamic conditions including error factors. Therefore, anti-blocking property thereof is poor. Considering transportation or storage thereof in a store house during summer, the toner base particles thereof are easily fused to each other, which impairs transportability, and transferring property, and forms defective images.

By satisfying the aforementioned conditions of Tg and TMA %, the toner of the present invention can realize both heat resistant storage stability (anti-blocking property) and low temperature fixing ability.

<TMA Compressive Deformation Rate (TMA %)>

The (TMA %) can be measured in the following manner.

The particulate toner (5 mg) is formed into a tablet by means of a pellet press (manufactured by Shimadzu Corporation) having a diameter of 3 mm. The obtained tablet sample is provided to a thermomechanical measurement device (EXSTAR7000, manufactured by Hitachi High-Tech Science Corporation). The measurement is performed with a compression mode by heating from 0° C. to 80° C. at the heating rate of 2° C./min under the condition of 70% RH. The compressive force for the measurement is set to 100 mN. From the obtained graph of the sample temperature and the compression displacement (deformation rate), the compression displacement (deformation rate) corresponding to 50° C. is read, and this value is determined as TMA %.

In the toner of the present invention, the crystalline polyester resin B content in the binder resin is preferably 3% by mass to 20% by mass. When the crystalline polyester resin B content is within the aforementioned range, the resulting toner is not melted in a storage environment, or by stirring in a developing device, and the viscoelasticity thereof is sharply dropped in certain temperature range. Accordingly, both low temperature fixing ability and anti-blocking property can be realized. When the aforementioned content is less than 3% by mass, low temperature fixing ability is not achieved and desirable fixing ability cannot be attained. When the aforementioned content is greater than 20% by mass, on the other hand, the toner has insufficient anti-blocking property, and thus aggregations of the toner are formed inside an image forming apparatus.

In order to improve anti-blocking property and low temperature fixing ability, a difference between Tg1st and Tg2nd of the toner of the present invention is preferably large, more preferably 10° C. or greater.

Moreover, the glass transition temperature (Tg2nd') of a THF insoluble component of the toner of the present invention, which is extracted from the toner, such as by Soxhlet extraction, is preferably −40° C. to 30° C. In addition, the THF insoluble component preferably has the storage elastic modulus G' of $10^6$ to $10^8$ at 40° C., and the storage elastic modulus G' of $10^5$ to $10^7$ at 100° C.

The toner of the present invention contains a polyester resin, which has a crosslink structure having a rubber elasticity, and therefore the toner can achieve anti-blocking property and anti-filming property, with having low glass transition temperature (Tg1st). The polyester resin, which exhibits rubber elasticity in the toner, is preferably crosslinked and polymerized to have high molecular weight to the level that is insoluble to a solvent, such as THF.

When Tg2nd thereof is lower than −40° C., it is difficult to prevent deformation of a resulting toner in the storage temperature range, even when crosslinks are formed, which may lead to undesirable anti-blocking property and anti-filming property of the toner. When Tg2nd thereof is higher than 30° C., the toner does not sufficiently melt in the fixing temperature range, leading to poor low temperature fixing ability.

When the storage elastic modulus G' of the THF insoluble component at 40° C. is less than $10^6$, it is difficult to prevent deformation of the toner in the storage temperature range, which may lead to poor anti-blocking property and anti-filming property. When the storage elastic modulus G' of the THF insoluble component at 40° C. is greater than $10^8$, the toner does not sufficiently melt in the fixing temperature range, leading to poor low temperature fixing ability.

When the storage elastic modulus G' of the THF insoluble component at 100° C. is less than $10^5$, the elasticity of the toner is insufficient in the fixing temperature range, which may lead to poor hot offset resistance of the toner during fixing. When the storage elastic modulus G' of the THF insoluble component at 100° C. is greater than $10^7$, the deformation of the toner is insufficient in the fixing temperature range, which may lead to insufficient low temperature fixing ability, and low glossiness of an image.

<Loss Tangent tan δ>

The loss tangent tan δ (i.e., a ratio of G"/G' of loss elastic modulus G" to storage elastic modulus G') preferably has the maximum value in the range of 20° C. to 70° C., more preferably in the range of 40° C. to 60° C.

When the maximum value of the loss tangent tan δ is less than 20° C., the toner will become easier to deform in response to external stress in its storage environment, and may be insufficient in heat resistant storage stability. When the maximum value of the loss tangent tan δ is more than 70° C., the toner will insufficiently deform in response to external stress upon fixing, and may be insufficient in low temperature fixing ability.

<Measuring Method of Storage Elastic Modulus G' and Loss Tangent tan δ>

The storage elastic modulus G' and the loss tangent tan δ of the toner and the THF insoluble component and the THF soluble component of the toner can be measured by means of a dynamic viscoelastometer (e.g., ARES of TA Instruments Japan Inc.). A frequency used for the measurement is 1 Hz.

Specifically, a sample is formed into a pellet having a diameter of 8 mm, and a thickness of 1 mm to 2 mm, and the pellet sample is fixed to a parallel plate having a diameter of 8 mm. Subsequently, the sample is adhered to the parallel plate at the temperature higher than Tg1st of the toner by 0° C. to 5° C., and the temperature is maintained for 60 minutes. Next, the sample is cooled down to −60° C. with maintaining load applied to the sample on the plate constant, and the sample is maintained for 60 minutes at −60° C. As for the measurement, the sample is heated to 200° C. at the heating rate of 2.0° C./min with strain of 0.1% (in a strain control mode) to thereby measure storage elastic modulus G' of the sample.

As for the colorant, any of dyes and pigments used for a colorant for a toner can be appropriately used. Specific examples thereof include carbon black, iron black, Sudan Black SM, Fast Yellow G, benzidine yellow, Solvent Yellow (21, 77, 114, etc.), Pigment Yellow (12, 14, 17, 83, etc.), India Fast Orange, Irgazine Red, p-nitroaniline red, toluidine red, Solvent Red (17, 49, 128, 5, 13, 22, 48.2, etc.), disperse red, Carmine FB, Pigment Orange R, Lake Red 2G, Rhodamine FB, Rhodamine B Lake, Methyl Violet B Lake, phthalocyanine blue, solvent blue (25, 94, 60, 15.3, etc.), pigment blue, brilliant green, phthalocyanine green, Oil Yellow GG, Kayaset YG, Orasol Brown B, and Oil Pink OP.

These may be used alone, or in combination.

Moreover, magnetic powder (e.g., powder of ferromagnetic metal, such as iron, cobalt, and nickel, and a compound, such as magnetite, hematite, and ferrite) also serving as a colorant can be optionally contained.

An amount of the colorant is preferably 0.1 parts by mass to 40 parts by mass, more preferably 0.5 parts by mass to 10 parts by mass, relative to 100 parts by mass of the binder resin. Note that, in the case where a magnetic powder is used, the amount of the colorant is preferably 20 parts by mass to 150 parts by mass, more preferably 40 parts by mass to 120 parts by mass.

The releasing agent is preferably a releasing agent having a softening point of 50° C. to 170° C. Examples thereof include polyolefin wax, natural wax (e.g., carnauba wax, montan wax, paraffin wax, and rice wax), C30-C50 aliphatic alcohol (e.g., triacontanol), C30-C50 fatty acid (e.g., triacontane carboxylic acid), and a mixture thereof. Other than those listed above, usable as the releasing agent are polymethylene (e.g., Fischer-Tropsch wax, such as Sasol wax), fatty acid metal salt (e.g., calcium stearate), and fatty acid ester (e.g., behenyl behenate).

Examples of the polyolefin wax include: a (co)polymer of olefin (e.g., ethylene, propylene, 1-butene, isobutylene, 1-hexene, 1-dodecene, 1-octadecene, and a mixture thereof) [including olefin compounds obtained by (co)polymerization, and thermodegradation polyolefin]; oxide of olefin (co) polymer with oxygen and/or ozone; a maleic acid-modified product [e.g., modified products with maleic acid and a derivative thereof (e.g., maleic anhydride, monomethyl maleate, monobutyl maleate, and dimethyl maleate)] of olefin (co)polymer; and a copolymer of olefin, unsaturated carboxylic acid [(meth)acrylic acid, itaconic acid, and maleic anhydride], and/or unsaturated carboxylic acid alkyl ester [e.g., alkyl (C1-C18 alkyl)(meth)acrylate, and alkyl (C1-C18 alkyl)maleate].

In the toner of the present invention, other than the materials listed above, additives, such as a charge controlling agent, and a flow improving agent can be optionally contained.

Examples of the charge controlling agent include a nigrosine dye, a triphenyl methane-based dye having tertiary amine in a side chain thereof, quaternary ammonium salt, a polyamine resin, imidazole derivative, quaternary ammonium salt group-containing polymer, a metal-containing azo dye, a copper phthalocyanine dye, metal salt of salicylic acid, a boron complex of benzilic acid, sulfonic acid group-containing polymer, fluorine-containing polymer, halogen-substituted aromatic ring-containing polymer, a metal complex of alkyl derivative of salicylic acid, and cetyltrimethyl ammonium bromide.

Examples of the flow improving agent include colloidal silica, alumina powder, titanium oxide powder, calcium carbonate powder, barium titanate, magnesium titanate, calcium titanate, strontium titanate, zinc oxide, quartz sand, clay, mica, wollastonite, diatomaceous earth, chromic oxide, cerium oxide, red iron oxide, antimony trioxide, magnesium oxide, zirconium oxide, barium sulfate, and barium carbonate.

As for the blending ratio of each component in the toner, the binder resin is preferably 30% by mass to 97% by mass, more preferably 40% by mass to 95% by mass, and even more preferably 45% by mass to 92% by mass; the colorant is preferably 0.05% by mass to 60% by mass, more preferably 0.1% by mass to 55% by mass, and even more preferably 0.5% by mass to 50% by mass; among the additives, the releasing agent is preferably 0% by mass to 30% by mass, more preferably 0.5% by mass to 20% by mass, and even more preferably 1% by mass to 10% by mass; the charge controlling agent is preferably 0% by mass to 20% by mass, more preferably 0.1% by mass to 10% by mass, and even more preferably 0.5% by mass to 7.5% by mass; and the flow improving agent is preferably 0% by mass to 10% by mass, more preferably 0% by mass to 5% by mass, and even more preferably 0.1% by mass to 4% by mass. Moreover, a total amount of the additives is preferably 3% by mass to 70% by mass, more preferably 4% by mass to 58% by mass, and even more preferably 5% by mass to 50% by mass.

A toner having excellent charging ability can be easily obtained when the components thereof are blended in the aforementioned rages.

As for a production method of the aforementioned toner, a conventional method, such as a kneading pulverizing method, a suspension polymerization method, an emulsification polymerization aggregation method, and emulsification phase inversion method, can be used.

The kneading pulverizing method is a method containing, after melt-kneading a binder resin together with a colorant etc., finely pulverizing the kneaded product, and classifying to thereby produce a toner. For example, after dry blending components constituting a toner exclusive of a flow improving agent, the resulting mixture is melt-kneaded, the kneaded product is roughly pulverized, the pulverized product is finally finely pulverized by a jet mill pulverizer or the like to fine particles, and then the resulting particles are classified into particles having the volume average particle diameter of about 5 μm to about 20 μm. Finally, the resultant is mixed with a flow improving agent, to thereby produce a toner. Note that, the volume average particle diameter can be measured by means of Coulter Counter [for example, product name: Multisizer III (manufactured by Beckman Coulter, Inc.)].

The suspension polymerization method is a method containing adding a monomer, a polymerization initiator, a colorant, a releasing agent, etc., to an aqueous phase containing a dispersion stabilizer with stirring, to form oil droplets, and then heating to perform a polymerization reaction of the oil droplets, to thereby obtain toner particles.

The emulsification polymerization aggregation method is a method, for example, using a polyester resin as a binder resin, in which particles obtained by removing a solvent, after emulsifying and dispersing in an aqueous phase, are aggregated with dispersed elements formed by dispersing a colorant, a releasing agent (wax), etc., in the aqueous phase, and the resultant is heated and fused, to thereby produce toner particles.

The emulsification phase inversion method is a method containing, after dissolving or dispersing components constituting a toner exclusive of a flow improving agent in an organic solvent, adding water or the like to the resulting solution or dispersion liquid to form an emulsion, followed by separating and classifying, to thereby produce a toner. Moreover, a toner may be produced by a method using organic particles disclosed in JP-A No. 2002-284881. The volume average particle diameter of the toner is preferably 3 μm to 15 μm.

<<Separation Unit for Constitutional Components of Toner>>

One example of a separation unit of each component for analyzing the toner is explained.

First, 1 g of a toner is added to 100 mL of tetrahydrofuran (THF), and the resultant is stirred for 30 minutes at 25° C. to thereby obtained a solution in which soluble components are dissolved. The solution is filtered through a membrane filter having an opening size of 0.2 μm, to thereby obtain a THF soluble component in the toner. Next, the THF soluble component is dissolved in THF to thereby prepare a sample for GPC. The sample is provided to GPC used for a measurement of a molecular weight of each resin mentioned earlier.

Meanwhile, a fraction collector is provided at an eluate outlet of GPC, and the eluate is fractionated per the predetermined count, to thereby obtain an eluate per 5% based on the area ratio from the elution onset of the elution curve (rise in the curve). Next, as for each fraction eluate, 30 g of the sample is dissolved in 1 mL of deuterated chloroform, to which 0.05% by volume of tetramethylsilane (TMS) is added as a standard substance. The resulting solution is poured into a glass tube for NMR measurement, having a diameter of 5 mm, and multiplication was performed 128 times by means of a nuclear magnetic resonance apparatus (JNM-AL400, manufactured by JEOL Ltd.) at the temperature of 23° C. to 25° C., to thereby obtain a spectrum.

Monomer compositions, constitutional ratios, etc. of the non-crystalline polyester resin and the crystalline polyester resin contained in the toner can be determined from a peak integration ratio of the obtained spectrum.

For example, the assignment of the peak is performed in the following manner, and a ratio of a constitutional monomer is determined from each integration ratio. The assignment of the peak is, for example, as follows:

- the vicinity of 8.25 ppm: originated from a benzene ring of trimellitic acid (for one hydrogen atom)
- the vicinity of 8.07 ppm to 8.10 ppm: originated from a benzene ring of terephthalic acid (for 4 hydrogen atoms)
- the vicinity of 7.1 ppm to 7.25 ppm: originated from a benzene ring of bisphenol A (for 4 hydrogen atoms)
- the vicinity of 6.8 ppm: originated from a benzene ring of bisphenol A (for 4 hydrogen atoms) and originated from a double bond of fumaric acid (for 2 hydrogen atoms)
- the vicinity of 5.2 ppm to 5.4 ppm: originated from methine of bisphenol A propylene oxide adduct (for 1 hydrogen atom)
- the vicinity of 3.7 ppm to 4.7 ppm: originated from methylene of bisphenol A propylene oxide adduct (for 2 hydrogen atoms), and originated from methylene of bisphenol A ethylene oxide adduct (for 4 hydrogen atoms)

the vicinity of 1.6 ppm: originated from a methyl group of bisphenol A (for 6 hydrogen atoms)

From these results, for example, an extract collected from a fraction in which the non-crystalline polyester resin occupies 90% by mass or greater is treated as the non-crystalline polyester resin. Moreover, an extract collected from the fraction in which the crystalline polyester resin B occupies 90% by mass or greater is treated as the crystalline polyester resin B.

—Extraction of THF Insoluble Component by Soxhlet Extraction—

The extraction of the THF insoluble component of the toner of the present invention is carried out in the following manner.

The toner (1 g) is subjected to refluxing for 12 hours with 100 g of THF, to thereby separated into a THF insoluble component and a THF soluble component. The solids obtained by removing THF from the THF soluble component, and solids obtained by removing THF from the THF insoluble component are dried for 20 hours at 40° C. under the atmospheric pressure, followed by vacuum drying the solids for 20 hours at 23° C. The resultants are respectively used as a THF soluble component, and THF insoluble component.

(Developer)

The developer of the present invention contains the toner of the present invention, and a carrier.

The toner is optionally mixed with carrier particles (e.g., iron powder, glass beads, nickel powder, ferrite, magnetite, and ferrite whose surface is coated with a resin (e.g., an acrylic resin, and a silicone resin)) and used as a developer for an electric latent image.

Moreover, instead of carrier particles, the toner may be abraded with a charging blade to cause frictions, to thereby develop an electric latent image. Then, the developed electric latent image is fixed on a support (e.g., paper, and a polyester film) by a conventional heat roller fixing method.

The developer of the present invention can be suitably used for image formation in various conventional electrophotographic methods, such as a magnetic one-component developing method, a non-magnetic one-component developing method, and a two-component developing method.

[Developer Container]

The developer container configured to house the developer of the present invention is appropriately elected from conventional containers without any limitation, and examples thereof include a container having a container main body and a cap.

The size, shape, structure and material of the developer container main body are appropriately selected depending on the intended purpose without any limitation. The shape of the developer container main body is, for example, preferably a cylinder, and particularly preferably a configuration of the container main body, in which recess (a convexo-concave shape) is spirally formed in the internal circumference surface to thereby enable the content, that is the developer, to move to the side of the discharging outlet by rotation of the container main body, and the part of or entire spiral recess section functions as bellows. The material of the container is appropriately selected depending on the intended purpose without any limitation, but it is preferably selected from materials that are excellent in dimensional accuracy on the production. Examples thereof include a polyester resin, a polyethylene resin, a polypropylene resin, a polystyrene resin, a polyvinyl chloride resin, polyacrylic acid, a polycarbonate resin, an ABS resin, and a polyacetal resin.

The developer container is easy to store and transport, excellent in handling, and can be suitably used in the process cartridge or image forming apparatus mentioned later to supply a developer by detachably mounting the developer container therein.

(Image Forming Method)

The image forming method using the toner of the present invention preferably contains at least a latent electrostatic image forming step, a developing step, a transferring step, and a fixing step, more preferably further contains a cleaning step, and may further contain a diselectrification step, a recycling step, and a controlling step, if necessary.

Moreover, an image forming apparatus for use in the present invention preferably contains at least a latent electrostatic image bearing member, a latent electrostatic image forming unit, a developing unit, transferring unit, and a fixing unit, more preferably further contains a cleaning unit, and may further contain a diselectrification unit, a recycling unit, and a controlling unit, if necessary.

The image forming method can be carried out by the image forming apparatus. The latent electrostatic image forming step can be carried out by the latent electrostatic forming unit, the developing step can be carried out by the developing unit, the transferring step can be carried out by the transferring unit, the fixing unit can be carried out by the fixing unit, and other steps can be carried out by other units.

<Latent Electrostatic Image Forming Step>

The latent electrostatic image forming step is forming a latent electrostatic image on a latent electrostatic image bearing member, such as a photoconductive insulator, and a photoconductor. A material, shape, structure, and size of the latent electrostatic image bearing member are appropriately selected from those known in the art without any limitation. The shape thereof is preferably a drum shape. Moreover, examples of the photoconductor include inorganic photoconductor (e.g., amorphous silicon, and selenium) and organic photoconductor (e.g., polysilane, and phthalopolymethine). Among them, amorphous silicon is preferable in view of a long service life.

A latent electrostatic image can be formed, for example, by uniformly charging a surface of the latent electrostatic image bearing member, and applying light imagewise, and can be formed by means of the latent electrostatic image forming unit. The latent electrostatic image forming unit contains, for example, at least a charger configured to apply voltage to a surface of the latent electrostatic image bearing member to uniformly charge the surface, and an exposing unit configured to apply light imagewise to the surface of the latent electrostatic image bearing member.

The charger is not particularly limited, and examples thereof include: conventional contact charging units equipped with an electric conductive or semiconductive roller, brush, film or rubber blade; and non-contact chargers utilizing corona discharge such as corotron, and scorotron.

The exposing unit is not particularly limited, provided that it is capable of applying light imagewise corresponded to an image to be formed, onto the surface of the latent electrostatic image bearing member charged by the charger. Examples of the exposing unit include various exposing units, such as a reproduction optical exposing device, a rod-lens array exposing device, a laser optical exposure device, and a liquid crystal shutter optical device. Note that, the exposing unit may employ a back light system, where the imagewise exposing is performed from the back side of the latent electrostatic image bearing member.

<Developing Step>

The developing step is developing the latent electrostatic image with the developer of the present invention to thereby form a toner image. The toner image (visible image) can be formed by means of the developing unit. The developing unit is not particularly limited, provided that it can perform developing using the developer of the present invention, and examples thereof include a unit, which houses the developer of the present invention therein, and contains at least a developing device capable of applying a toner to the latent electrostatic image in a contact or non-contact manner. The developer unit is preferably a developing device equipped with the developer container.

The developing device may employ either a dry developing system or a wet developing system, and may be a developing device for a single color, or a developing device for multicolor. Examples thereof include a device containing a stirrer configured to charge the developer of the present invention by frictions from stirring, and a rotatable magnet roller. In the developing device, for example, the toner and the carrier are mixed and stirred, and the toner is charged by the friction from the stirring. The charged toner is held on the surface of the rotatable magnetic roller in the form of a brush to form a magnetic brush. The magnetic roller is provided adjacent to the latent electrostatic image bearing member, part of the toner forming the magnetic brush on the surface of the magnetic roller is moved to the surface of the latent electrostatic image bearing member by electrical attraction force. As a result, the latent electrostatic image is developed with the toner to form a toner image on the surface of the latent electrostatic image bearing member. Note that, the developer housed in the developing device is the developer of the present invention, which may be a one-component developer, or a two-component developer.

<Transferring Step>

The transferring step is charging the latent electrostatic image bearing member, on which the toner image is formed, by means of a transfer charger, to thereby transfer the toner image to a recording medium, and the transferring can be performed by means of the transferring unit. The transferring step preferably contains a first transferring step, which contains transferring the toner image onto an intermediate transfer member, and a second transferring step, which contains transferring the toner image, which has been transferred onto the intermediate transfer member, to a recording medium. The transferring step more preferably contains a first transferring step, which contains transferring toner images of each color, which are formed with a toner of two or more colors, or full-color toner, onto an intermediate transfer member to form a composite toner image, and a second transferring step, which contains transferring the composite toner image formed on the intermediate transfer member onto a recording medium.

The transferring unit preferably contains a first transferring unit configured to transfer the toner image onto an intermediate transfer member to form a composite toner image, and a second transferring unit configured to transfer the composite toner image formed onto the intermediate transfer member to a recording medium. Note that, the intermediate transfer member is not particularly limited, and examples thereof include an endless transfer belt. Moreover, the transferring unit (first transferring unit, second transferring unit) preferably contains at least a transfer device configured to charge the toner image formed on the latent electrostatic image bearing member to release the toner image from the photoconductor to the side of the recording medium. Note that, the transferring unit can has one, or two or more transfer devices.

Examples of the transfer device include a corona transfer device utilizing corona discharge, a transfer belt, a transfer roller, a pressure transfer roller, and an adhesion transfer member.

Note that, the recording medium is appropriately selected from conventional recording mediums (recording paper), without any limitation.

<Fixing Step>

The fixing step is fixing the toner image transferred on the recording medium, and the fixing can be performed by means of the fixing unit. Note that, in the case where two or more colors of the toner are used, fixing may be performed every time when an image formed of the toner of each color is transferred onto the recording medium. Alternatively, fixing may be performed after the toners of all the colors are transferred to the recording medium in a laminated state. The fixing unit is not particularly limited, and any of conventional heating and pressurizing units can be used as the fixing unit. Examples of the heating and pressurizing unit include a combination of a heat roller and a press roller, and a combination of a heat roller, a press roller, and an endless belt. The heating temperature for the fixing is typically 80° C. to 200° C. Note that, if required, for example, a conventional optical fixing unit may be used together with, or instead of the fixing unit.

<Diselectrification Step>

The diselectrification step is applying a diselectrification bias to the latent electrostatic image bearing member for diselectrification thereof, and the diselectrification can be performed by the diselectrification unit. The diselectrification unit is not particularly limited, as long as it is capable of applying a diselectrification bias to the latent electrostatic image bearing member, and examples thereof include a diselectrification lamp.

<Cleaning Step>

The cleaning step is removing the toner remained on the latent electrostatic image bearing member, and the cleaning step can be performed by means of the cleaning unit. The cleaning unit is not particularly limited, as long as it is capable of removing the toner remained on the latent electrostatic image bearing member, and examples thereof include a magnetic brush cleaner, an electrostatic brush cleaner, a magnetic roller cleaner, a blade cleaner, a brush cleaner, and a web cleaner.

<Recycling Step>

The recycling step is recycling the toner, which has been removed in the cleaning step, to the developing unit, and the recycling step can be performed by means of the recycling unit. The recycling unit is not particularly limited, and examples thereof include conventional conveying units.

<Controlling Step>

The controlling step is controlling each step, and the controlling step can be performed by the controlling unit. The controlling unit is not particularly limited as long as it can control operations of each unit, and examples thereof include devices such as a sequencer, and a computer.

An example of the image forming apparatus for use in the present invention is illustrated in FIG. 1. The image forming apparatus 100A is equipped with a photoconductor 10 serving as a latent electrostatic image bearing member, a charging device 20 serving as a charging unit, an exposing device serving as is an exposing unit (not illustrated), a developing devices 45 (K, Y, M, C), each serving as a developing unit, an intermediate transfer member 50, a cleaning device 60 serving as a cleaning unit, and a diselectrification lamp 70 serving as a diselectrification unit.

The intermediate transfer member 50 is an endless belt, and is designed to rotate in the direction indicated with an arrow by three rollers 51 disposed inside the intermediate transfer member 50 to support the intermediate transfer member 50. Part of the three rollers 51 also functions as a transfer bias roller capable of applying a predetermined transfer bias (primary transfer bias) to the intermediate transfer member 50.

In the surrounding area of the intermediate transfer member 50, the cleaning device 90 having a cleaning blade is provided, and the transfer roller 80 serving as the transferring unit capable of applying a transfer bias for transferring (secondary transferring) a toner image to the recording medium 95 is provided to face the intermediate transfer member 50.

In the surrounding area of the intermediate transfer member 50, the corona charger 52, which is configured to apply a charge to the toner image on the intermediate transfer member 50, is provided in the area situated between the contact area of the photoconductor 10 and the intermediate transfer member 50, and the contact area of the intermediate transfer member 50 and the recording medium 95.

The developing device 45 of each color, black (K), yellow (Y), magenta (M), and cyan (C) is equipped with a developing container 42 (K, Y, M, C), a developer supply roller 43, and a developing roller 44.

In the image forming apparatus 100A, the charging roller 20 uniformly charges the photoconductor drum 10, followed by exposing the photoconductor drum to exposure L imagewise by the exposing device (not illustrated), to thereby form a latent electrostatic image. Next, the latent electrostatic image formed on the photoconductor drum 10 is developed by supplying the developer from the developing device 45 to form a toner image. Thereafter, a transfer bias is applied from the roller 51 to transfer the toner image on the intermediate transfer member (first transferring). The toner image on the intermediate transfer member 50 is then provided with electric charges from the corona charger 52, followed by being transferred onto recording paper 95 (secondary transferring). Note that, the toner remained on the photoconductor drum 10 is removed by the cleaning device 60, and the photoconductor drum 10 is diselectrified by a diselectrification lamp 70.

Figure 2:
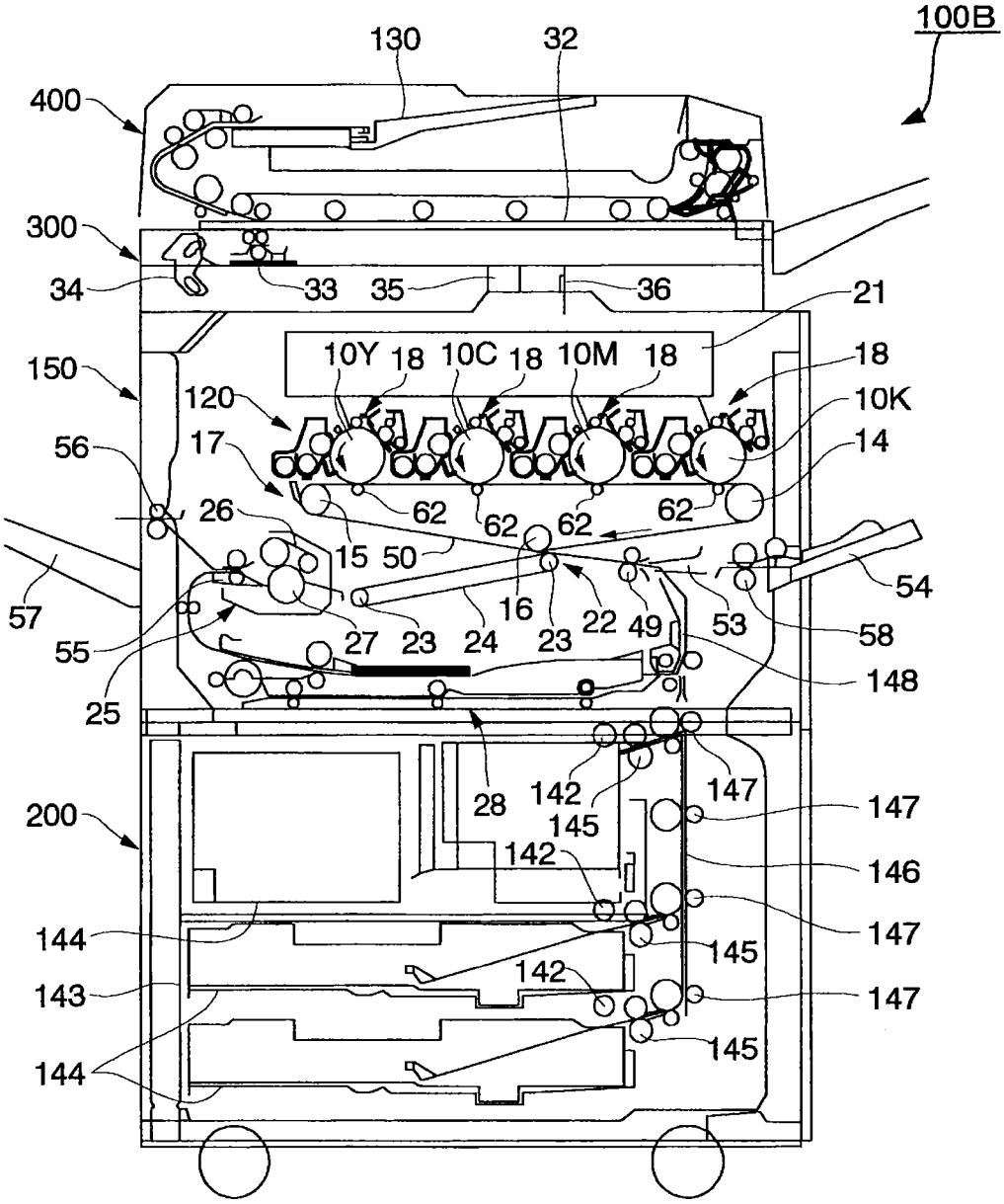
FIG. 2 is a schematic diagram illustrating another example of the image forming apparatus of the present invention.

FIG. 2 illustrates another exemplary image forming apparatus of the present invention. An image forming apparatus 100B in FIG. 2 is a tandem color image forming apparatus, and includes a copying device main body 150, a paper-feeding table 200, a scanner 300 and an automatic document feeder (ADF) 400.

The copying device main body 150 is provided at its center portion with an endless belt-form intermediate transfer member 50. The intermediate transfer member 50 can be rotated with being stretched by support rollers 14, 15 and 16 in a direction indicated by the arrow.

A cleaning unit 17 configured to remove the toner particles remaining on the intermediate transfer member 50 is disposed in the vicinity of the support roller 15. Around the intermediate transfer member 50 stretched by the support rollers 14 and 15 is provided a tandem developing device 120 in which four image forming units 18 for yellow, cyan, magenta and black toners are arranged in a row along the moving direction of the intermediate transfer member.

Figure 3:
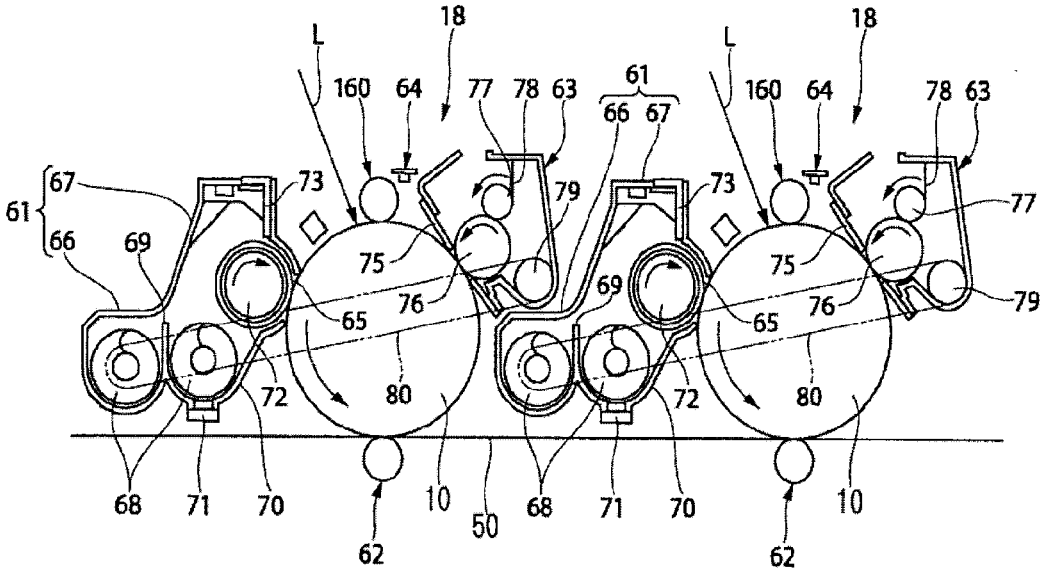
FIG. 3 is a schematic diagram illustrating an image forming unit of each color.

As illustrated in FIG. 3, each of the image forming units 18 includes: a photoconductor drum 10; a charging roller 160 which uniformly charges the photoconductor drum 10; a developing device 70 which forms a toner image by developing a latent electrostatic image formed on the photoconductor drum 10 with a developer of black (K), yellow (Y), magenta (M) or cyan (C); a transfer roller 62 which transfers the toner image onto an intermediate transfer member 50; a cleaning device 60; and a diselectrification lamp 70.

In the image forming apparatus illustrated in FIG. 2, an exposing device (not illustrated) is provided adjacent to a tandem developing device 120. The exposing device is configured to apply exposure light onto the photoconductive drum 10 to thereby form a latent electrostatic image.

Moreover, a secondary transferring device 22 is provided on the opposite side of the intermediate transfer member 50 to the side thereof where the tandem developing device 120 is provided. The secondary transferring device 22 is composed of a secondary transfer belt 24, which is an endless belt supported by a pair of rollers 23, and is designed so that recording paper conveyed on the secondary transfer belt 24 and the intermediate transfer member 50 can be in contact with each other.

The fixing device 25 is provided adjacent to the secondary transferring device 22. The fixing device 25 contains a fixing belt 26, which is an endless belt, and a press roller 27, which is provided to press against the fixing belt 26.

Moreover, a reverser 28 configured to reverse recording paper to form images on both sides of the recording paper is provided adjacent to the secondary transferring device 22 and the fixing device 25.

Next, formation of a full-color image (color copy) in the image forming apparatus 100B is explained. First, a document is set on a document table 130 of the automatic document feeder (ADF) 400. Alternatively, the automatic document feeder (ADF) 400 is opened, a document is set on a contact glass 32 of the scanner 300, and then the ADF 400 is closed. In the case where the document is set on the ADF 400, once a start switch (not illustrated) is pressed, the document is transported onto the contact glass 32, and then the scanner 300 is driven to scan the document with a first carriage 33 equipped with a light source and a second carriage 34 equipped with a mirror. In the case where the document is set on the contact glass 32, the scanner 300 is immediately driven in the same manner as mentioned. During this scanning operation, light applied from a light source of the first carriage 33 is reflected on the surface of the document, the reflected light from the document is further reflected by a mirror of the second carriage 34, and passed through an image formation lens 35, which is then received by a read sensor 36. In this manner, the color document (color image) is read, and image information of black, yellow, magenta, and cyan is obtained.

A latent electrostatic image of each color is formed on the photoconductor drum 10 by the exposing device based on the obtained image information of each color. Thereafter, the latent electrostatic image of each color is developed with the developer supplied from the developing device 120 for each color, to thereby form a toner image of each color. The formed toner images of these colors are sequentially transferred (primary transferred) to the intermediate transfer member 50, which is rotated by the supporting rollers 14, 15, and 16, to thereby form a composite toner image on the intermediate transfer member.

In the feeding table 200, one of the feeding rollers 142 is selectively rotated to eject a sheet (recording paper) from one of multiple feeder cassettes 144 of a paper bank 143, the ejected sheets are separated one by one by a separation roller 145 to send to a feeder path 146, and then transported by a transport roller 147 into a feeder path 148 within the apparatus main body 150. The sheet transported in the feeder path 148 is then bumped against a registration roller 49 to stop. Alternatively, sheets (recording paper) on a manual-feeding tray 54 are ejected, separated one by one by a separation roller 58 to guide into a manual feeder path 53, and then bumped against the registration roller 49 to stop. Note that, the registration roller 49 is generally earthed at the time of the use, but it may be biased for removing paper dust of the recording paper.

Next, the registration roller 49 is rotated synchronously with the movement of the composite toner image superimposed on the intermediate transfer member 50 to send the recording paper between the intermediate transfer member 50 and the secondary transfer device 22, to thereby transfer the composite toner image onto the recording paper (secondary transferring).

The recording paper on which the composite toner image has been transferred is transported by a secondary transfer device 22 to send to a fixing device 25. In the fixing device 25, the composite toner image is heated and pressurized by the fixing belt 26 and the press roller to thereby fix the composite toner image onto the recording paper. Thereafter, the recording paper is changed its traveling direction by a switch craw 55, ejected by an ejecting roller 56, and then stacked on an output tray 57. Alternatively, the recording paper is changed its traveling direction by the switch craw 55, reversed by the reverser 28 to send to a transfer position, to thereby record an image on the back side thereof. Then, the recording paper is ejected by the ejecting roller 56, and stacked on the output tray 57.

Note that, the toner remained on the intermediate transfer member 50 after the composite toner image is transferred is removed by the cleaning device 17.

(Process Cartridge)

The process cartridge of the present invention is designed in a manner that it is detachably mounted in various image forming apparatuses, and contains at least a latent electrostatic image bearing member configured to bear a latent electrostatic image thereon, and a developing unit configured to develop the latent electrostatic image on the latent electrostatic image bearing member with the developer of the present invention to form a toner image. Note that, the process cartridge of the present invention may further contain other units, if necessary.

The developing unit contains at least a developer container configured to house the developer of the present invention therein, and a developer bearing member configured to bear the developer housed in the developer container and transport the developer. Note that, the developing unit may further contain a regulating member configured to regulate a thickness of the developer borne on the developer bearing member.

Figure 4:
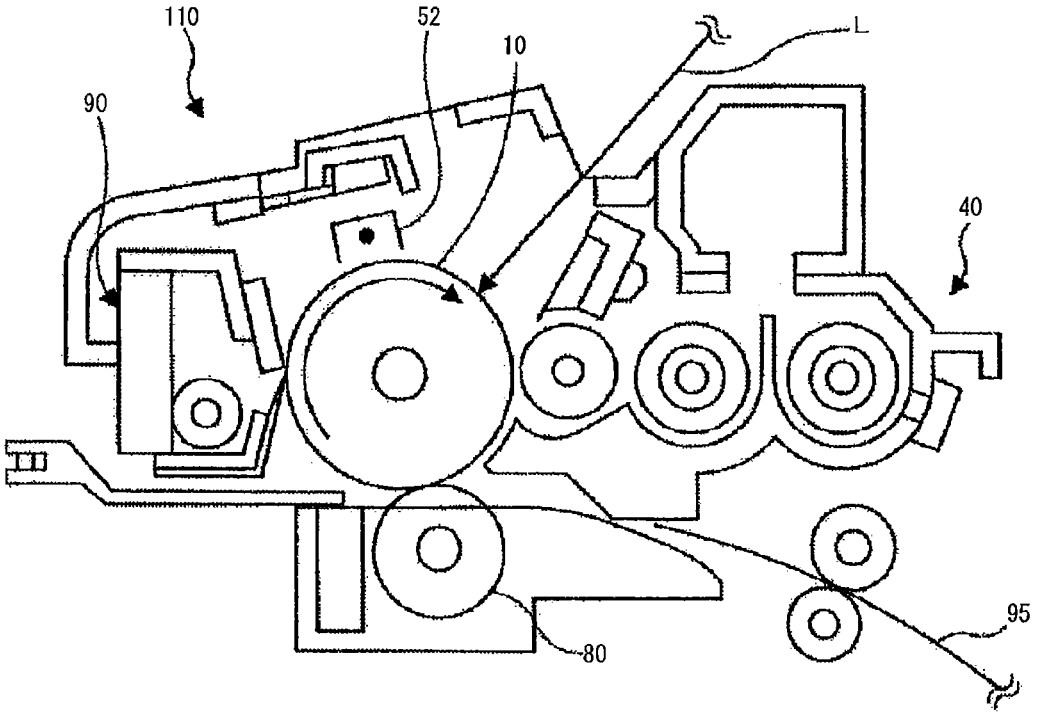
FIG. 4 is a schematic diagram illustrating one example of the process cartridge of the present invention.

FIG. 4 illustrates one example of the process cartridge of the present invention.

The process cartridge 110 contains a photoconductor drum 10, a corona charger 52, a developing device 40, a transfer roller 80, and a cleaning device 90.

EXAMPLES

The present invention will be specifically explained through Examples and Comparative Examples hereinafter, but Examples shall not be construed to limit the scope of the present invention. Note that, "part(s)" and "%" in the description below are all mass basis.

Toners of Examples and Comparative Examples were produced in the following manners.

<Production of Toner>

—Synthesis of Ketimine Compound—

A reaction vessel equipped with a stirring bar, and a thermometer was charged with 170 parts of isophorone diamine, and 75 parts of methyl ethyl ketone, and the resulting mixture was allowed to react for 5 hours at 50° C., to thereby obtain Ketimine Compound. Ketimine Compound had the amine value of 418.

—Preparation of Master Batch (MB)—

To 1,200 parts of water, 540 parts of carbon black (Printex35, manufactured by Evonik Degussa Japan Co., Ltd.) [DBP oil absorption value=42 mL/100 mg, pH=9.5], and 1,200 parts of Non-Crystalline Polyester Resin A, and the resulting mixture was mixed by HENSCHEL MIXER (manufactured by Nippon Cole & Engineering Co., Ltd.). The resulting mixture was kneaded by a two-roll mill for 30 minutes at 150° C., followed by rolled and cooled. Then the resultant was pulverized by a pulverized to thereby obtain Master Batch.

—Production of Pigment-Wax Dispersion Liquid—

A vessel equipped with a stirring bar and a thermoset was charged with 220 parts of Unsaturated Double Bond-Containing Crystalline Polyester Resin B, 50 parts of paraffin wax (HNP-9, manufactured by NIPPON SEIRO CO., LTD., hydrocarbon-based wax, melting point: 75° C., SP value: 8.8) as a releasing agent, 22 parts of CCA (salicylic acid metal complex E-84, manufactured by Orient Chemical Industries, Ltd.), and 947 parts of ethyl acetate, and the resulting mixture was heated to 80° C. with stirring, temperature of which was kept at 80° C. for 5 hours, followed by cooling to 30° C. over 1 hour. Subsequently, 500 parts of Master Batch and 500 parts of ethyl acetate were added to the vessel, and the resulting mixture was mixed for 1 hour, to thereby obtain Raw Material Solution.

Raw Material Solution (1,324 parts) was transferred into a vessel, and dispersed by means of a bead mill (ULTRA VISCOMILL, manufactured by AIMEX CO., Ltd.) under the conditions: a liquid feed rate of 1 kg/hr, disk circumferential velocity of 6 m/sec, 0.5 mm-zirconia beads packed to 80% by volume, and 3 passes. Subsequently, 1,042.3 parts of a 65% Non-Crystalline Polyester Resin A ethyl acetate solution was added thereto, and the resultant was passed through the bead mill once under the same conditions to the above, to thereby obtain Pigment-Wax Dispersion Liquid. The solid content (130° C., 30 min) of Pigment-Wax Dispersion Liquid was 50%.

—Preparation of Oil Phase—

A vessel was charged with 664 parts of Pigment-Wax Dispersion Liquid, 80 parts of Prepolymer, and 4.6 parts of Ketimine Compound, and the resulting mixture was mixed by means of TK Homomixer (manufactured by PRIMIX Corporation) at 5,000 rpm for 1 minute, to thereby obtain Oil Phase. Here, Prepolymer was Reactive Group-Containing Non-Linear Polyester Resin A-1-1 described later.

—Synthesis of Organic Particle Emulsion (Particle Dispersion Liquid)—

A vessel equipped with a stirring bar and a thermometer was charged with 683 parts of water, 11 parts of sodium salt of sulfuric acid ester of methacrylic acid-ethylene oxide adduct (ELEMINOL RS-30, manufactured by Sanyo Chemical Industries, Ltd.), 138 parts of styrene, 138 parts of methacrylic acid, and 1 part of ammonium persulfate, and the resulting mixture was stirred for 15 minutes at 400 rpm, to thereby obtain a white emulsion. The obtained emulsion was heated until the internal system temperature reached 75° C., and was allowed to react for 5 hours. To this, 30 parts of a 1% ammonium persulfate aqueous solution was added, and the resulting mixture was aged for 5 hours at 75° C., to thereby obtain an aqueous dispersion liquid of a vinyl-based resin (styrene-methacrylic acid-sodium salt of sulfuric acid ester of methacrylic acid-ethylene oxide adduct copolymer), i.e. Pigment Dispersion Liquid. The volume average particle diameter of Pigment Dispersion Liquid as measured by LA-920

(manufactured by HORIBA, Ltd.) was 0.14 μm. Part of Pigment Dispersion Liquid was dried to separate a resin component.

—Preparation of Aqueous Phase—

Water (990 parts), 83 parts of Pigment Dispersion Liquid, 37 parts of a 48.5% sodium dodecyldiphenyl ether disulfonate aqueous solution (ELEMINOL MON-7, manufactured by Sanyo Chemical Industries, Ltd.), and 90 parts of ethyl acetate were mixed together and stirred, to thereby obtain a milky white fluid, which was used as Aqueous Phase.

—Emulsification and Removal of Solvent—

To the vessel in which Oil Phase had been charged, 1,200 parts of Aqueous Phase was added, and the resulting mixture was mixed by means of TK Homomixer at 13,000 rpm for 20 minutes, to thereby obtain Emulsified Slurry.

A vessel equipped with a stirrer, and a thermometer was charged with Emulsified Slurry, and the solvent was removed therefrom at 30° C. for 8 hours.

—Unsaturated Group Reaction Process—

To the obtained slurry from which the solvent had been removed, a catalyst quantity of a water-soluble radical polymerization initiator (V-44, manufactured by Wako Pure Chemical Industries, Ltd.) was added, and the resultant was aged for 5 hours at 50° C., to carry out a reaction with the unsaturated double bonds of Crystalline Polyester Resin B, to thereby obtain Dispersion Slurry.

—Washing and Drying—

After filtering 100 parts of Dispersion Slurry under the reduced pressure, the resultant was subjected to the following operations (1) to (5).

(1): To the filtration cake, 100 parts by mass of ion-exchanged water was added, and the mixture was mixed (at 12,000 rpm for 10 minutes) by the TK Homomixer, followed by filtering the mixture.

(2): To the filtration cake obtained in (1), 100 parts by mass of a 10% by mass sodium hydroxide aqueous solution was added, and the mixture was mixed (at 12,000 rpm for 30 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 12,000 rpm for 10 minutes) by the TK Homomixer, followed by filtering the mixture.

(4): To the filtration cake obtained in (3), 300 parts by mass of ion-exchanged water was added, and the mixture was mixed (at 12,000 rpm for 10 minutes) by the TK Homomixer, followed by filtering the mixture. The series of the operations (1) to (4) were performed twice, to thereby obtain Filtration Cake.

(5): Filtration Cake obtained in (4) was dried with an air-circulating drier for 48 hours at 45° C., and was then passed through a sieve with a mesh size of 75 μm, to thereby obtain a toner.

Synthesis Example 1

—Synthesis of Reactive Group-Containing Non-Linear Polyester Resin A-1-1—

A reaction vessel equipped with a cooling tube, a stirrer, and a nitrogen-inlet tube was charged with a mixture containing 3-methyl-1,5-pentanediol and trimethylol propane at a molar ratio of 97:3 (alcohol components), and adipic acid (an acid component) in amounts that satisfied OH:COOH=1.1:1, together with titanium tetraisopropoxide (300 ppm relative to the resin component). Thereafter, the mixture was heated to 200° C. over about 4 hours, followed by heating to 230° C. over 2 hours, and the mixture was allowed to react until effluent run out. Thereafter, the resultant was further allowed to react for 5 hours under the reduced pressure of 10 mmHg to 15 mmHg, to thereby obtain intermediate polyester. Next, a reaction vessel equipped with a cooling tube, a stirrer, and a nitrogen-inlet tube was charged with the intermediate polyester and isophorone diisocyanate at a molar ratio of 2.1:1, and the mixture was diluted with ethyl acetate to 48% by mass. Thereafter, the resultant was allowed to react for 5 hours at 100° C., to thereby obtain Reactive Group-Containing Non-Linear Polyester Resin A-1-1. Reactive Group-Containing Non-Linear Polyester Resin A-1-1 had the number average molecular weight (Mn) of 3,800, weight average molecular weight (Mw) of 17,500, and Tg of −50° C.

Synthesis Example 2

—Synthesis of Reactive Group-Containing Non-Linear Polyester Resin A-1-2—

A reaction vessel equipped with a cooling tube, a stirrer, and a nitrogen-inlet tube was charged with a mixture containing 3-methyl-1,5-pentanediol, a bisphenol A ethylene oxide (2 mol) adduct, and trimethylol propane at a molar ratio of 20:77:3 (alcohol components), and a mixture containing adipic acid and terephthalic acid at a molar ratio of 50:50 (acid components) in amounts that satisfied OH:COOH=1.1:1, together with titanium tetraisopropoxide (300 ppm relative to the resin component). Thereafter, the mixture was heated to 200° C. over about 4 hours, followed by heating to 230° C. over 2 hours, and the mixture was allowed to react until effluent run out. Thereafter, the resultant was further allowed to react for 5 hours under the reduced pressure of 10 mmHg to 15 mmHg, to thereby obtain intermediate polyester. Next, a reaction vessel equipped with a cooling tube, a stirrer, and a nitrogen-inlet tube was charged with the intermediate polyester and isophorone diisocyanate at a molar ratio of 2.1:1, and the mixture was diluted with ethyl acetate to 48% by mass. Thereafter, the resultant was allowed to react for 5 hours at 100° C., to thereby obtain Reactive Group-Containing Non-Linear Polyester Resin A-1-2. Reactive Group-Containing Non-Linear Polyester Resin A-1-2 had the number average molecular weight (Mn) of 4,200, weight average molecular weight (Mw) of 18,900, and Tg of 31° C.

Synthesis Example 3

—Synthesis of Reactive Group-Containing Non-Linear Polyester Resin A-1-3—

A reaction vessel equipped with a cooling tube, a stirrer, and a nitrogen-inlet tube was charged with a mixture containing 3-methyl-1,5-pentanediol and trimethylol propane at a molar ratio of 97:3 (alcohol components), and a mixture containing adipic acid and terephthalic acid at a molar ratio of 50:50 (acid components) in amounts that satisfied OH:COOH=1.1:1, together with titanium tetraisopropoxide (300 ppm relative to the resin component). Thereafter, the mixture was heated to 200° C. over about 4 hours, followed by heating to 230° C. over 2 hours, and the mixture was allowed to react until effluent run out. Thereafter, the resultant was further allowed to react for 5 hours under the reduced pressure of 10 mmHg to 15 mmHg, to thereby obtain intermediate polyester. Next, a reaction vessel equipped with a cooling tube, a stirrer, and a nitrogen-inlet tube was charged with the intermediate polyester and isophorone diisocyanate at a molar ratio of 2.1:1, and the mixture was diluted with ethyl acetate to 48% by mass. Thereafter, the resultant was allowed to react for 5 hours at 100° C., to thereby obtain Reactive Group-Containing Non-Linear Polyester Resin A-1-3. Reactive Group-Containing Non-Linear Polyester Resin A-1-3 had the number average molecular weight (Mn) of 5,200, weight average molecular weight (Mw) of 32,900, and Tg of −30° C.

Synthesis Example 4

—Synthesis of Reactive Group-Containing Non-Linear Polyester Resin A-1-4—

A reaction vessel equipped with a cooling tube, a stirrer, and a nitrogen-inlet tube was charged with a mixture containing 3-methyl-1,5-pentanediol and trimethylol propane at a molar ratio of 96:4 (alcohol components), and a mixture containing adipic acid and terephthalic acid at a molar ratio of 50:50 (acid components) in amounts that satisfied OH:COOH=1.1:1, together with titanium tetraisopropoxide (300 ppm relative to the resin component). Thereafter, the mixture was heated to 200° C. over about 4 hours, followed by heating to 230° C. over 2 hours, and the mixture was allowed to react until effluent run out. Thereafter, the resultant was further allowed to react for 5 hours under the reduced pressure of 10 mmHg to 15 mmHg, to thereby obtain intermediate polyester. Next, a reaction vessel equipped with a cooling tube, a stirrer, and a nitrogen-inlet tube was charged with the intermediate polyester and isophorone diisocyanate at a molar ratio of 2.1:1, and the mixture was diluted with ethyl acetate to 48% by mass. Thereafter, the resultant was allowed to react for 5 hours at 100° C., to thereby obtain Reactive Group-Containing Non-Linear Polyester Resin A-1-4. Reactive Group-Containing Non-Linear Polyester Resin A-1-4 had the number average molecular weight (Mn) of 5,600, weight average molecular weight (Mw) of 42,000, and Tg of −27° C.

Synthesis Example 5

—Synthesis of Reactive Group-Containing Non-Linear Polyester Resin A-1-5—

A reaction vessel equipped with a cooling tube, a stirrer, and a nitrogen-inlet tube was charged with a mixture containing 3-methyl-1,5-pentanediol and trimethylol propane at a molar ratio of 98:2 (alcohol components), and a mixture containing adipic acid and terephthalic acid at a molar ratio of 50:50 (acid components) in amounts that satisfied OH:COOH=1.1:1, together with titanium tetraisopropoxide (300 ppm relative to the resin component). Thereafter, the mixture was heated to 200° C. over about 4 hours, followed by heating to 230° C. over 2 hours, and the mixture was allowed to react until effluent run out. Thereafter, the resultant was further allowed to react for 5 hours under the reduced pressure of 10 mmHg to 15 mmHg, to thereby obtain intermediate polyester. Next, a reaction vessel equipped with a cooling tube, a stirrer, and a nitrogen-inlet tube was charged with the intermediate polyester and isophorone diisocyanate at a molar ratio of 1.9:1, and the mixture was diluted with ethyl acetate to 48% by mass. Thereafter, the resultant was allowed to react for 5 hours at 100° C., to thereby obtain Reactive Group-Containing Non-Linear Polyester Resin A-1-5. Reactive Group-Containing Non-Linear Polyester Resin A-1-5 had the number average molecular weight (Mn) of 3,200, weight average molecular weight (Mw) of 15,000, and Tg of −35° C.

Synthesis Example 6

—Synthesis of Reactive Group-Containing Non-Linear Polyester Resin A-1-6—

A reaction vessel equipped with a cooling tube, a stirrer, and a nitrogen-inlet tube was charged with a mixture containing 3-methyl-1,5-pentanediol, a bisphenol A ethylene oxide (2 mol) adduct, and trimethylol propane at a molar ratio of 27:70:3 (alcohol components), and a mixture containing adipic acid and terephthalic acid at a molar ratio of 50:50 (acid components) in amounts that satisfied OH:COOH=1.1:1, together with titanium tetraisopropoxide (300 ppm relative to the resin component). Thereafter, the mixture was heated to 200° C. over about 4 hours, followed by heating to 230° C. over 2 hours, and the mixture was allowed to react until effluent run out. Thereafter, the resultant was further allowed to react for 5 hours under the reduced pressure of 10 mmHg to 15 mmHg, to thereby obtain intermediate polyester. Next, a reaction vessel equipped with a cooling tube, a stirrer, and a nitrogen-inlet tube was charged with the intermediate polyester and isophorone diisocyanate at a molar ratio of 2.1:1, and the mixture was diluted with ethyl acetate to 48% by mass. Thereafter, the resultant was allowed to react for 5 hours at 100° C., to thereby obtain Reactive Group-Containing Non-Linear Polyester Resin A-1-6. Reactive Group-Containing Non-Linear Polyester Resin A-1-6 had the number average molecular weight (Mn) of 4,500, weight average molecular weight (Mw) of 19,000, and Tg of 29° C.

Synthesis Example 7

—Synthesis of Reactive Group-Containing Non-Linear Polyester Resin A-1-7—

A reaction vessel equipped with a cooling tube, a stirrer, and a nitrogen-inlet tube was charged with a mixture containing 3-methyl-1,5-pentanediol and trimethylol propane at a molar ratio of 97:3 (alcohol components), and a mixture containing adipic acid and terephthalic acid at a molar ratio of 70:30 (acid components) in amounts that satisfied OH:COOH=1.1:1, together with titanium tetraisopropoxide (300 ppm relative to the resin component). Thereafter, the mixture was heated to 200° C. over about 4 hours, followed by heating to 230° C. over 2 hours, and the mixture was allowed to react until effluent run out. Thereafter, the resultant was further allowed to react for 5 hours under the reduced pressure of 10 mmHg to 15 mmHg, to thereby obtain intermediate polyester. Next, a reaction vessel equipped with a cooling tube, a stirrer, and a nitrogen-inlet tube was charged with the intermediate polyester and isophorone diisocyanate at a molar ratio of 2.1:1, and the mixture was diluted with ethyl acetate to 48% by mass. Thereafter, the resultant was allowed to react for 5 hours at 100° C., to thereby obtain Reactive Group-Containing Non-Linear Polyester Resin A-1-7. Reactive Group-Containing Non-Linear Polyester Resin A-1-7 had the number average molecular weight (Mn) of 4,300, weight average molecular weight (Mw) of 18,500, and Tg of −40° C.

Synthesis Example 8

—Synthesis of Polyester Resin A-2-1—

A 5 L four-necked flask equipped with a nitrogen-inlet tube, a condenser, a stirrer, and a thermocouple was charged with a mixture containing a bisphenol A ethylene oxide (2 mol) adduct and a bisphenol A propylene oxide (3 mol) adduct at a molar ratio of 85:15 (alcohol components), and a mixture containing isophthalic acid and adipic acid at a molar ratio of 80:20 (acid components), and at the ratio of OH:COOH=1.3:1. The resulting mixture was allowed to react together with 500 ppm of titanium tetraisopropoxide for 10 hours at 230° C. under the atmospheric pressure, followed by further reacting for 5 hours under the reduced pressure of 10 mmHg to 15 mmHg. Thereafter, 30 parts of trimellitic anhydride was added to the flask, and the mixture was allowed to react for 3 hours at 180° C. under the atmospheric pressure, to thereby obtain Linear Polyester Resin A-2-1. Linear Polyester Resin A-2-1 had the number average molecular weight (Mn) of 2,400, the weight average molecular weight (Mw) of 5,400, and Tg of 48° C.

Synthesis Example 9

—Synthesis of Polyester Resin A-2-2—

Linear Polyester Resin A-2-2 was synthesized in the same manner as in Synthesis Example 8, provided that the molar ratio of isophthalic acid and adipic acid was changed to 20:80, the bisphenol A propylene oxide (3 mol) adduct in the alcohol component was changed to propylene glycol, and the loading ratio was changed to OH:COOH=1.2:1. Linear Polyester Resin A-2-2 had the number average molecular weight (Mn) of 4,000, the weight average molecular weight (Mw) of 12,000, and Tg of 29° C.

Synthesis Example 10

—Synthesis of Polyester Resin A-2-3—

A 5 L four-necked flask equipped with a nitrogen-inlet tube, a condenser, a stirrer, and a thermocouple was charged with a mixture containing a bisphenol A ethylene oxide (2 mol) adduct and a bisphenol A propylene oxide (3 mol) adduct at a molar ratio of 60:40 (alcohol components), and a mixture containing terephthalic acid and adipic acid at a molar ratio of 90:10 (acid components), and at the ratio of OH:COOH=1.3:1. The resulting mixture was allowed to react together with 500 ppm of titanium tetraisopropoxide for 10 hours at 230° C. under the atmospheric pressure, followed by further reacting for 5 hours under the reduced pressure of 10 mmHg to 15 mmHg. Thereafter, 30 parts of trimellitic anhydride was added to the flask, and the mixture was allowed to react for 3 hours at 180° C. under the atmospheric pressure, to thereby obtain Linear Polyester Resin A-2-3. Linear Polyester Resin A-2-3 had the number average molecular weight (Mn) of 2,500, the weight average molecular weight (Mw) of 5,800, and Tg of 65° C.

Synthesis Example 11

—Synthesis of Unsaturated Double Bond-Containing Crystalline Polyester Resin B—

A two-necked flask, which had been heated and dried, was charged with a mixture containing dimethyl fumarate and dimethyl sebacate at the molar ratio of 90:10 (acid components), 1,6-hexanediol (an alcohol component) in an amount that was 1.15 times the amount of the acid components, and $Ti(OBu)_4$ as a catalyst. Thereafter, nitrogen purging was performed to replace the air inside the flask with nitrogen gas inert atmosphere by decompression, and reflux was performed by mechanical stirring for 5 hours at 180° C. Thereafter, the excess 1,6-hexanediol was removed by vacuum distillation. While gradually heating the resultant to 230° C., the resultant was stirred for 2 hours. Once the resultant became viscose, it was cooled with air to terminate the reaction. Before the reaction product was solidified, tetrahydrofuran (THF) was added to the flask, and the catalyst residue was removed by a pressure filtration device. As for purification, the redeposit sediment was collected using THF/MeOH, and dried under the reduced pressure, to thereby obtain Unsaturated Double Bond-Containing Crystalline Polyester Resin B. Unsaturated Double Bond-Containing Crystalline Polyester Resin B had the number average molecular weight (Mn) of 3,900, the weight average molecular weight (Mw) of 13,800, and the melting point of 68° C.

Example 1

A toner was prepared in the aforementioned manner using Resin A-1-1, Resin A-2-1, and Resin B at the ratio depicted in the column of Example 1 in Table 1. Specifically, Resin A-1-1, Resin A-2-1, and Resin B were mixed so that Resin A-1-1 was 10%, Resin A-2-1 was 80%, and Resin B was 10%.

Example 2

Crystalline Polyester Resin B' was synthesized in the same manner as in Synthesis Example 11, provided that 1,6-hexanediol was replaced with ethylene. Crystalline Polyester Resin B' had the number average molecular weight (Mn) of 3,800, the weight average molecular weight (Mw) of 16,200, and the melting point of 77° C.

A toner was prepared in the same manner as in Example 1, provided that Resin B was replaced with Resin B'.

Example 3

A toner was prepared in the same manner as in Example 1, provided that Resin A-1-1 was not used, and Resin A-2-1 was replaced with Resin A-2-2.

Example 4

A toner was prepared in the same manner as in Example 1, provided that the Resin B content was changed to 5% by mass.

Example 5

A toner was prepared in the same manner as in Example 1, provided that the Resin B content was changed to 15% by mass.

Example 6

A toner was prepared in the same manner as in Example 1, provided that the Resin B content was changed to 20% by mass.

Example 7

A toner was prepared in the same manner as in Example 1, provided that the Resin A-1-1 content was changed to 20% by mass, and the Resin B content was changed to 3% by mass.

Example 8

A toner was prepared in the same manner as in Example 1, provided that the Resin A-1-1 content was changed to 3% by mass, and the Resin B content was changed to 3% by mass.

Example 9

A toner was prepared in the same manner as in Example 1, provided that Resin A-2-1 was replaced with Resin A-2-2, and the Resin B content was changed to 15% by mass.

Example 10

A toner was prepared in the same manner as in Example 1, provided that Resin A-1-1 was replaced with Resin A-1-2.

Example 11

A toner was prepared in the same manner as in Example 1, provided that Resin A-1-1 was replaced with Resin A-1-3.

Example 12

A toner was prepared in the same manner as in Example 1, provided that Resin A-1-1 was replaced with Resin A-1-4.

Example 13

A toner was prepared in the same manner as in Example 1, provided that Resin A-1-1 was replaced with Resin A-1-5.

Example 14

A toner was prepared in the same manner as in Example 11, provided that Resin B was replaced with stearic acid amide (Neutron-2, manufactured by NIPPON FINE CHEMICAL CO., LTD., melting point: 95° C.).

Example 15

A toner was prepared in the same manner as in Example 11, provided that the Resin B content was changed to 0% by mass.

Example 16

A toner was prepared in the same manner as in Example 1, provided that Resin A-1-1 was replaced with Resin A-1-6.

Example 17

A toner was prepared in the same manner as in Example 1, provided that Resin A-1-1 was replaced with Resin A-1-7.

Comparative Example 1

Polyester Resin A-1' was synthesized in the same manner as in Synthesis Example 1, provided that the alcohol component was changed to propylene glycol, and the composition of the acid was changed to terephthalic acid/adipic acid/trimellitic acid=80/17.5/2.5. Polyester Resin A-1' had the number average molecular weight (Mn) of 5,500, the weight average molecular weight (Mw) of 45,000, and Tg of 56° C.

A toner was prepared in the same manner as in Example 1, provided that Resin A-1-1 was replaced with Resin A-1'.

Comparative Example 2

A toner was prepared in the same manner as in Example 1, provided that the Resin A-1-1 content was changed to 30% by mass.

Comparative Example 3

A toner was prepared in the same manner as in Example 1, provided that the Resin B content was changed to 25% by mass.

Comparative Example 4

A toner was prepared in the same manner as in Example 1, provided that Resin B was replaced with polybutylene succinate sebacate (manufactured by Sigma-Aldrich Co., LLC) which did not contain unsaturated double bonds.

Comparative Example 5

Crystalline Polyester Resin B" was synthesized in the same manner as in Synthesis Example 11, provided that the entire acid component was changed to dimethyl sebacate. Crystalline Polyester Resin B" had the number average molecular weight (Mn) of 3,600, the weight average molecular weight (Mw) of 14,000, and the melting point of 63° C.

A toner was prepared in the same manner as in Example 1, provided that Resin B was replaced with Resin B".

Properties of each toner of Examples and Comparative Examples were measured and evaluated in the following manner.

The results are presented in Tables 1, 2, and 3.

—Softening Point (Tm)—

After preheating 1 g of a measuring sample to 50° C. by means of a capillary rheometer (CFT-500D, manufactured by Shimadzu Corporation), a load of 30 kg was applied to the sample by a plunger, while heating the sample at the heating rate of 5° C./min, to extrude the sample from a nozzle having a diameter of 0.5 mm, and a length of 1 mm. A graph was drawn from "a dropped amount of the plunger (flow value)" and "temperature." The temperature corresponding to ½ the maximum value of the dropped amount of the plunger was read from the graph, and this value (temperature at which a half of the measuring sample was flown out) was determined as a softening point.

—Anti-Blocking Property—

A glass vessel was charged with the toner, and was left to stand for 24 hours in a thermostat which was kept at 50° C. Thereafter, the toner in the vessel was cooled to 24° C., and a degree of blocking (aggregations) was evaluated based on the following criteria.

[Evaluation Criteria]

A: Blocking did not occur.

B: Blocking occurred, but they were easily dispersed as a force was applied, which was not a problem on practical use.

C: Blocking occurred, and they were not dispersed even when a force was applied.

D: Blocking occurred, and the toner was completely fixed and could not be removed as a powder.

A developer was prepared using each toner of Examples and Comparative Examples in the following manner.

—Production of Carrier—

To 100 parts of toluene, 100 parts of a silicone resin (organo straight silicone), 5 parts of γ-(2-aminoethyl)aminopropyl trimethoxy silane, and 10 parts of carbon black were added, and the resulting mixture was dispersed by Homomixer for 20 minutes, to thereby prepare a resin layer coating liquid.

Subsequently, the resin layer coating liquid was applied to surfaces of spherical magnetite (1,000 parts) having the average particle diameter of 50 μm by means of a fluidized bed coater, to thereby produce a carrier.

—Production of Developer—

By means of a ball mill, 5 parts of each toner and 95 parts of the carrier were mixed, to thereby produce a developer.

Each developer produced was evaluated in the following manner, in terms of fixing property and coloring.

<Fixing Temperature>

A copying test was performed on type 6200 paper (manufactured by Ricoh Company Limited) by means of a modified photocopier (MF2200, manufactured by Ricoh Company Limited) a fixing section of which had been modified using a Teflon (registered trade mark) roller.

Specifically, cold offset temperature (minimum fixing temperature) and hot offset temperature (maximum fixing temperature) were determined with varying the fixing temperature.

As for the evaluation conditions for the minimum fixing temperature, the linear velocity of paper feeding was set to 120 mm/sec to 150 mm/sec, the bearing was set at 1.2 kgf/cm$^2$, and the nip width was set to 3 mm.

As for the evaluation conditions for the maximum fixing temperature, moreover, the linear velocity of paper feeding was set to 50 mm/sec, the bearing was set at 2.0 kgf/cm$^2$, and the nip width was set to 4.5 mm.

Furthermore, the range of the cold offset temperature (minimum fixing temperature) to the hot offset temperature (maximum fixing temperature) was determined as a fixing temperature width.

Here, as for the fixing property, the minimum fixing temperature of 115° C. or lower, and the fixing temperature width of 40° C. or more are preferable on practical use.

<Anti-Filming Property>

A solid image was formed on an entire sheet by means of an image forming apparatus MF2800 (manufactured by Ricoh Company Limited) to give a toner deposition amount 0.40 mg/cm$^2$, and was printed on 10,000 sheets in total. Thereafter, the photoconductor was visually observed, and whether or not toner components (mainly the releasing agent) were adhered on the photoconductor was evaluated based on the following criteria.

[Evaluation Criteria]

A: No adherence of the toner components was observed.

B: The adherence of the toner components was observed, but it was a level where there would be no problem on practical use.

C: The adherence of the toner components was observed, but it was a level where there would be a problem on practical use.

D: The adherence of the toner components was observed, but it was a level where there would be a significant problem on practical use.

<Transfer White Missing>

The developer was loaded on Ricoh pro 6100 (manufactured by Ricoh Company Limited), and an A4-size image having an imaging area of 5% was continuously printed on 10,000 sheets. Subsequently, a solid image (toner deposition amount: 0.4 mg/cm$^2$) was formed on an entire area of A4-size paper, and printed on 3 sheets in total. Thereafter, white missing parts in the images were observed visually, and under an optical microscope. The results are evaluated based on the following criteria.

[Evaluation Criteria]

A: No white missing area was visually observed on all of the 3 sheets.

B: White missing areas were observed on the third sheet under the optical microscope, but it was not a level where there would be a problem on practical use.

C: One to ten white missing areas were visually observed in total on the three sheets, and it was a level where there would be a problem on practical use.

D: Eleven or more white missing areas were visually observed in total on the three sheets, and it was a level where there would be a significant problem on practical use.

<Image Density>

The carrier and the toner used in Imageo MP C4300 (manufactured by Ricoh Company Limited) were mixed to give a toner density of 5% by mass, to thereby obtain a developer.

A unit of the Imageo MP C4300 (manufactured by Ricoh Company Limited) was charged with the developer, and a rectangular solid image in the size of 2 cm×15 cm was formed on PPC sheet, Type 6000 <70W> A4, long grain paper (manufactured by Ricoh Company Limited) to give a toner deposition amount of 0.40 mg/cm$^2$. The surface temperature of the fixing roller was set to 120° C. Next, the image density (ID) of the solid image was measured by means of X-Rite 938 (manufactured by X-Rite) with a status A-mode, and d50 light.

[Evaluation Criteria]

A: 1.5 or greater

B: 1.4 or greater but less than 1.5

C, 1.2 or greater but less than 1.4

D: Less than 1.2

<Glossiness>

A printing test was performed on Type 6200 paper (manufactured by Ricoh Company Limited) by means of a device, in which a fixing unit of a photocopier MF 2200 (manufactured by Ricoh Company Limited) using Teflon (registered trade mark) roller as a fixing roller had been modified. Specifically, the fixing temperature was set to the temperature that was the minimum fixing temperature+20° C., where the minimum fixing temperature was determined as the low temperature fixing ability was evaluated, the linear speed of the paper feeding was set to 120 mm/sec to 150 mm/sec, the bearing was set to 2 kgf/cm$^2$, and the nip width was set to 3 mm. The 60° gloss of the image after the printing test was measured by means of a glossimeter VG-7000 (manufactured by NIPPON DENSHOKU INDUSTRIES Co., Ltd.). The results were evaluated based on the following criteria.

[Evaluation Criteria]

A: 30% or greater

B: 25% or greater but less than 30%

C: 20% or greater but less than 25%

D: Less than 20%

TABLE 1

| | | Ex. 1 | Ex. 2 | Ex. 3 | Ex. 4 | Ex. 5 | Ex. 6 | Ex. 7 | Ex. 8 |
|---|---|---|---|---|---|---|---|---|---|
| | Resin A | A-1-1<br>A-2-1 | A-1-1<br>A-2-1 | —<br>A-2-2 | A-1-1<br>A-2-1 | A-1-1<br>A-2-1 | A-1-1<br>A-2-1 | A-1-1<br>A-2-1 | A-1-1<br>A-2-1 |
| | Resin B | B | B' | B | B | B | B | B | B |
| Toner | Resin A-1 content (%) | 10 | 10 | 0 | 10 | 10 | 10 | 20 | 3 |
| | Resin B content (%) | 10 | 10 | 10 | 5 | 15 | 20 | 3 | 10 |
| | Tg1st (° C.) | 34 | 33 | 29 | 33 | 33 | 32 | 25 | 45 |

TABLE 1-continued

| | | Ex. 1 | Ex. 2 | Ex. 3 | Ex. 4 | Ex. 5 | Ex. 6 | Ex. 7 | Ex. 8 |
|---|---|---|---|---|---|---|---|---|---|
| | Tg2nd (° C.) | 19 | 18 | 17 | 24 | 15 | 10 | 20 | 30 |
| | Tg1st − Tg2nd (° C.) | 15 | 15 | 12 | 9 | 18 | 22 | 5 | 15 |
| | Tm (° C.) | 67 | 75 | 67 | 67 | 67 | 67 | 67 | 67 |
| | TMA % | 6.6 | 6.8 | 4.5 | 5.8 | 6.8 | 8.7 | 10 | 4.3 |
| | Tg2nd' of THF insoluble component | −42 | −42 | — | −42 | −42 | −42 | −42 | −42 |
| | G' (40° C.) of THF insoluble component | $1.2 \times 10^7$ | $1.4 \times 10^7$ | — | $1.8 \times 10^7$ | $1.1 \times 10^7$ | $8.2 \times 10^6$ | $7.8 \times 10^6$ | $1.1 \times 10^7$ |
| | G' (100° C.) of THF insoluble component | $1.5 \times 10^6$ | $1.8 \times 10^5$ | — | $2.1 \times 10^5$ | $1.2 \times 10^5$ | $9.5 \times 10^5$ | $8.5 \times 10^5$ | $1.2 \times 10^6$ |
| | Max. temp. of tanδ (° C.) | 45 | 39 | 41 | 44 | 39 | 39 | 35 | 61 |
| | Anti-blocking property | A | B | A | A | B | B | B | A |
| Developer | Minimum fixing temperature | 95 | 110 | 105 | 110 | 95 | 95 | 110 | 115 |
| | Fixing temperature width | 70 | 70 | 45 | 75 | 60 | 50 | 70 | 45 |
| | Anti-filming property | B | B | B | B | B | B | B | B |
| | Transfer white missing | B | B | B | B | B | B | B | B |
| | Image density | A | A | A | A | A | A | A | A |
| | Glossiness | A | A | A | A | A | A | A | A |

TABLE 2

| | | Ex. 9 | Ex. 10 | Ex. 11 | Ex. 12 | Ex. 13 | Ex. 14 | Ex. 15 | Ex. 16 |
|---|---|---|---|---|---|---|---|---|---|
| | Resin A | A-1-1 A-2-2 | A-1-2 A-2-1 | A-1-3 A-2-1 | A-1-4 A-2-1 | A-1-5 A-2-1 | A-1-3 A-2-1 | A-1-3 A-2-1 | A-1-6 A-2-1 |
| | Resin B | B | B' | B | B | B | 1* | — | B |
| Toner | Resin A-1 content (%) | 10 | 10 | 10 | 10 | 10 | 10 | 10 | 10 |
| | Resin B content (%) | 15 | 10 | 10 | 10 | 10 | (10) | 0 | 10 |
| | Tg1st (° C.) | 49 | 48 | 28 | 30 | 26 | 28 | 28 | 45 |
| | Tg2nd (° C.) | 30 | 32 | 15 | 15 | 15 | 17 | 22 | 27 |
| | Tg1st − Tg2nd (° C.) | 19 | 16 | 13 | 15 | 11 | 11 | 6 | 18 |
| | Tm (° C.) | 67 | 67 | 67 | 67 | 67 | 67 | 67 | 67 |
| | TMA % | 4.1 | 4.2 | 5 | 4.3 | 7.2 | 4.9 | 8.8 | 4.4 |
| | Tg2nd' of THF insoluble component | −42 | 32 | −20 | −15 | −28 | −20 | −20 | 29 |
| | G' (40° C.) of THF insoluble component | $1.9 \times 10^7$ | $1.1 \times 10^7$ | $1.4 \times 10^7$ | $1.4 \times 10^6$ | $9.5 \times 10^5$ | $1.4 \times 10^7$ | $1.4 \times 10^7$ | $1.5 \times 10^7$ |
| | G' (100° C.) of THF insoluble component | $2.2 \times 10^6$ | $1.2 \times 10^6$ | $1.2 \times 10^6$ | $1.2 \times 10^7$ | $9.6 \times 10^4$ | $1.2 \times 10^6$ | $1.2 \times 10^6$ | $1.4 \times 10^6$ |
| | Max. temp. of tanδ (° C.) | 63 | 62 | 42 | 45 | 38 | 38 | 42 | 58 |
| | Anti-blocking property | A | A | A | A | B | B | A | A |
| Developer | Minimum fixing temperature | 110 | 110 | 95 | 105 | 95 | 105 | 115 | 100 |
| | Fixing temperature width | 60 | 70 | 85 | 70 | 50 | 75 | 85 | 80 |

TABLE 2-continued

| | Ex. 9 | Ex. 10 | Ex. 11 | Ex. 12 | Ex. 13 | Ex. 14 | Ex. 15 | Ex. 16 |
|---|---|---|---|---|---|---|---|---|
| Anti-filming property | B | A | A | A | B | B | A | A |
| Transfer white missing | B | A | A | A | B | B | A | A |
| Image density | A | A | A | B | A | B | B | A |
| Glossiness | A | A | A | B | A | B | B | A |

TABLE 3

| | | Ex. 17 | Comp. Ex. 1 | Comp. Ex. 2 | Comp. Ex. 3 | Comp. Ex. 4 | Comp. Ex. 5 |
|---|---|---|---|---|---|---|---|
| Toner | Resin A | A-1-7<br>A-2-1 | A-1'<br>A-2-1 | A-1-1<br>A-2-1 | A-1-1<br>A-2-1 | A-1-1<br>A-2-1 | A-1-1<br>A-2-1 |
| | Resin B | B | B | B | B | *2 | B" |
| | Resin A-1 content (%) | 10 | 10 | 30 | 10 | 10 | 10 |
| | Resin B content (%) | 10 | 10 | 10 | 25 | (10) | 10 |
| | Tg1st (° C.) | 35 | 52 | 20 | 29 | 31 | 30 |
| | Tg2nd (° C.) | 20 | 40 | 8 | 10 | 23 | 18 |
| | Tg1st − Tg2nd (° C.) | 15 | 12 | 12 | 19 | 8 | 12 |
| | Tm (° C.) | 67 | 67 | 67 | 67 | 95 | 62 |
| | TMA % | 5 | 5.3 | 15.3 | 17.6 | 13.2 | 15.4 |
| | Tg2nd' of THF insoluble component | −39 | 48 | −43 | −44 | −42 | −42 |
| | G' (40° C.) of THF insoluble component | $1.1 \times 10^7$ | $2.3 \times 10^8$ | $1.6 \times 10^7$ | $8.1 \times 10^6$ | $1.6 \times 10^7$ | $1.1 \times 10^7$ |
| | G' (100° C.) of THF insoluble component | $1.3 \times 10^6$ | $1.5 \times 10^7$ | $1.5 \times 10^6$ | $9.2 \times 10^5$ | $1.5 \times 10^6$ | $1.2 \times 10^6$ |
| | Max. temp. of tanδ (° C.) | 42 | 72 | 25 | 32 | 38 | 19 |
| | Anti-blocking property | A | A | C | D | C | C |
| Developer | Minimum fixing temperature | 95 | 125 | 110 | 90 | 130 | 100 |
| | Fixing temperature width | 85 | 70 | 90 | 45 | 45 | 45 |
| | Anti-filming property | A | B | C | D | C | C |
| | Transfer white missing | A | B | C | D | C | C |
| | Image density | A | C | D | B | D | B |
| | Glossiness | A | C | D | B | D | B |

Note that, in Tables 2 and 3, "*1" and "*2" respectively denote "stearic acid amide" and "polybutylene succinate sabacate", white are used as a replacement of Resin B. The contents thereof are both 10%, as depicted in the column of the Resin B content with a blackest.

The embodiments of the present invention are, for example, as follows:

<1> A toner, containing:

a colorant;

a binder resin; and a releasing agent, wherein the toner satisfies the following (a) to (c):

(a) the toner contains at least a polyester resin as the binder resin;

(b) the toner has Tg1st of 25° C. to 50° C.; and (c) the toner has a TMA compressive deformation rate (TMA %) of 10% or lower at 50° C. under a condition having relative humidity of 70%, wherein the Tg1st is glass transition temperature of the toner for first heating, as the toner is measured by a DSC system (a differential scanning calorimeter).

<2> The toner according to <1>, wherein a tetrahydrofuran (THF) insoluble component of the toner has Tg2nd' of −40° C. to 30° C. as measured by differential scanning calorimetry (DSC), and the THF insoluble component has storage elastic modulus G' of $10^6$ to $10^8$ at 40° C., and storage elastic modulus G' of $10^5$ to $10^7$ at 100° C.

<3> The toner according to any of <1> or <2>, wherein the Tg1st of the toner—Tg2nd of the toner is 10° C. or greater, where the Tg2nd is glass transition temperature of the toner for second heating, as the toner is measured by a DSC system (differential scanning calorimeter).

<4> The toner according to any one of <1> to <3>, wherein the polyester resin contains a plurality of polyester resins, and at least one of the polyester resins is a non-crystalline polyester resin containing a diol component as a constitutional component, where the diol component contains C3-C10 aliphatic diol in an amount of 50 mol % or greater, and trivalent or higher acid or trihydric or higher alcohol as a crosslink component.

<5> The toner according to <4>, wherein a number of carbon atoms in a principle chain of the diol component is an odd number, and the diol component has an alkyl group at a side chain thereof.

<6> The toner according to any of <4> or <5>, wherein the crosslink component is trivalent acid or trihydric alcohol.

<7> The toner according to any one of <1> to <3>, wherein the polyester resin contains a plurality of polyester resins, and at least one of the polyester resins is a non-crystalline polyester resin is obtained through a reaction between an active hydrogen group-containing compound and a polymer reactable with the active hydrogen group-containing compound.

<8> The toner according to any one of <1> to <7>, wherein the polyester resin is composed of a non-crystalline polyester resin A and a crystalline polyester resin B.

<9> The toner according to <8>, wherein a crystalline polyester resin B content is 3% by mass to 20% by mass.

<10> The toner according to any of <8> or <9>, wherein the crystalline polyester resin B has a crosslink structure formed from unsaturated double bond segments.

<11> The toner according to any one of <8> to <10>, wherein the crystalline polyester resin B has a melting point of 60° C. to 80° C., and the polyester resin B contains a C4-C12 linear saturated aliphatic dicarboxylic acid in an amount of 80 mol % or greater relative to a total acid component, and C2-C12 linear saturated aliphatic diol in an amount of 80 mol % or greater relative to a total alcohol component.

<12> A developer, containing:

the toner according to any one of <1> to <11>; and a carrier.

<13> A process cartridge, containing:

a latent electrostatic image bearing member; and a developing unit configured to develop a latent electrostatic image formed on the latent electrostatic image bearing member with a toner to form a visible image, wherein the toner is the toner according to any one of <1> to <11>.

<14> An image forming apparatus, containing:

the process cartridge according to <13>.

This application claims priority to Japanese application No. 2012-204162, filed on Sep. 18, 2012 and incorporated herein by reference.

What is claimed is:

1. A toner, comprising:

a colorant;

a binder resin; and a releasing agent, wherein the toner satisfies the following (a) to (c):

(a) the toner contains at least a polyester resin as the binder resin;

(b) the toner has Tg1st of 25° C. to 50° C.; and (c) the toner has a TMA compressive deformation rate (TMA %) of 10% or lower at 50° C. under a condition having relative humidity of 70%, wherein the Tg1st is glass transition temperature of the toner for first heating, as the toner is measured by a DSC system (a differential scanning calorimeter), and wherein a tetrahydrofuran (THF) insoluble component of the toner has Tg2nd' of −40° C. to 30° C. as measured by differential scanning calorimeter (DSC), and the THF insoluble component has storage elastic modulus G' of $10^6$ to $10^8$ at 40° C., and a storage elastic modulus G' of $10^5$ to $10^7$ at 100° C., wherein the polyester resin contains a plurality of polyester resins, and at least one of the polyester resins is a non-crystalline polyester resin containing a diol component as a constitutional component, where the diol component contains C3-C10 aliphatic diol in an amount of 50 mol % or greater, and trivalent or higher acid or trihydric or higher alcohol as a crosslink component, and wherein a number of carbon atoms in a principle chain of the diol component is an odd number, and the diol component has an alkyl group at a side chain thereof.

2. The toner according to claim 1, wherein the Tg1st of the toner—Tg2nd of the toner is 10° C. or greater, where the Tg2nd is glass transition temperature of the toner for second heating, as the toner is measured by a DSC system (differential scanning calorimeter).

3. The toner according to claim 1, wherein the crosslink component is trivalent acid or trihydric alcohol.

4. The toner according to claim 1, wherein the polyester resin is composed of said non-crystalline polyester resin and a crystalline polyester resin B.

5. The toner according to claim 4, wherein a crystalline polyester resin B content is 3% by mass to 20% by mass.

6. The toner according to claim 4, wherein the crystalline polyester resin B has a crosslink structure formed from unsaturated double bond segments.

7. The toner according to claim 4, wherein the crystalline polyester resin B has a melting point of 60° C. to 80° C., and the polyester resin B contains a C4-C12 linear saturated aliphatic dicarboxylic acid in an amount of 80 mol % or greater relative to a total acid component, and C2-C12 linear saturated aliphatic diol in an amount of 80 mol % or greater relative to a total alcohol component.

8. A developer, comprising:

a toner; and a carrier, wherein the toner is the toner according to claim 1.

9. The toner according to claim 1, wherein:

the polyester resin is composed of said non-crystalline polyester resin and a crystalline polyester resin B; and the crystalline polyester resin B has a melting point of 60° C. to 80° C., and the polyester resin B contains a C4-C12 linear saturated aliphatic dicarboxylic acid in an amount of 80 mol % or greater relative to a total acid component, and C2-C12 linear saturated aliphatic diol in an amount of 80 mol % or greater relative to a total alcohol component.

* * * * *